US011029003B2

(12) United States Patent
Matsushita et al.

(10) Patent No.: US 11,029,003 B2
(45) Date of Patent: Jun. 8, 2021

(54) DECORATION DEVICE, METHOD FOR USING LIGHT EMITTING DEVICE, AND VEHICLE

(71) Applicant: TOSHIBA HOKUTO ELECTRONICS CORPORATION, Asahikawa (JP)

(72) Inventors: Koichi Matsushita, Asahikawa (JP); Takamasa Ootake, Kawasaki (JP)

(73) Assignee: Toshiba Hokuto Electronics Corporation, Asahikawa (JP)

( * ) Notice: Subject to any disclaimer, the term of this patent is extended or adjusted under 35 U.S.C. 154(b) by 0 days.

(21) Appl. No.: 16/519,543

(22) Filed: Jul. 23, 2019

(65) Prior Publication Data

US 2020/0072448 A1 Mar. 5, 2020

(30) Foreign Application Priority Data

Sep. 3, 2018 (JP) ..... JP2018-164962

(51) Int. Cl.

| | |
|---|---|
| ***F21V 21/00*** | (2006.01) |
| ***F21V 19/00*** | (2006.01) |
| ***F21S 43/14*** | (2018.01) |
| *F21Y 105/16* | (2016.01) |
| *F21Y 115/10* | (2016.01) |

(52) U.S. Cl.

CPC ..... *F21V 19/0015* (2013.01); *F21S 43/14* (2018.01); *F21Y 2105/16* (2016.08); *F21Y 2115/10* (2016.08)

(58) Field of Classification Search

CPC ..... F21V 19/0015; F21S 43/14; F21S 43/15; F21S 43/50; F21Y 2105/16

USPC ..... 362/549, 545, 249.08, 249.04

See application file for complete search history.

(56) References Cited

U.S. PATENT DOCUMENTS

2005/0243569 A1* 11/2005 Rodriguez Barros ..... B60R 1/1207 362/494
2013/0329444 A1* 12/2013 Oh ..... F21S 43/195 362/543
2015/0283936 A1* 10/2015 Nakamura ..... B60Q 1/0088 362/549
2017/0250330 A1 8/2017 Maki
2020/0025348 A1* 1/2020 Jung ..... F21S 43/14
2020/0063941 A1* 2/2020 Yamamoto ..... F21S 43/195

FOREIGN PATENT DOCUMENTS

JP 2012-084855 A1 4/2012
WO 2016/047134 A1 3/2016

* cited by examiner

*Primary Examiner* — Laura K Tso
(74) *Attorney, Agent, or Firm* — Burr & Brown, PLLC

(57) ABSTRACT

A decoration device according to this embodiment is a decoration device decorating an object used indoors, including: a light emitting device having light transmittivity and flexibility, including a plurality of light emitting elements emitting light from one surface and the other surface, and being arranged on one side of the object, in which a distance between the object and the light emitting device when an indoor light is turned off is less than or equal to 90 cm.

3 Claims, 21 Drawing Sheets

TABLE 1

| INDOOR LIGHT | DISTANCE Dx | 0cm | 30cm | 60cm | 90cm | 120cm | 150cm |
|---|---|---|---|---|---|---|---|
| TURN OFF LIGHT | ILLUMINANCE 1 | 100Lx | 100Lx | 100Lx | 100Lx | 100 | - |
| | ILLUMINANCE 2 | - | 161Lx | 145Lx | 129Lx | 112 | - |
| | SCALE | 4.8 | 1.12 | 0.8 | 0.56 | NOT SEEN | - |
| | EVALUATION | ◎ | ◎ | ○ | △ | × | × |

TABLE 2

| INDOOR LIGHT | DISTANCE Dx | 0cm | 30cm | 60cm | 90cm | 120cm | 150cm |
|---|---|---|---|---|---|---|---|
| TURN ON LIGHT | ILLUMINANCE 1 | 456Lx | 456Lx | 456Lx | 456Lx | 456Lx | 456Lx |
| | ILLUMINANCE 2 | – | 499Lx | 476Lx | 456Lx | 456Lx | 456Lx |
| | SCALE | 4.8 | 1.92 | 1.6 | 0.96 | 0.8 | 0.56 |
| | EVALUATION | ◎ | ◎ | ◎ | ◎ | ○ | △ |

TABLE 3

| INDOOR LIGHT | DISTANCE Dx | 0cm | 30cm | 60cm | 90cm | 120cm | 150cm |
|---|---|---|---|---|---|---|---|
| TURN ON LIGHT | ILLUMINANCE 1 | 100000Lx | 100000Lx | 100000Lx | 100000Lx | 100000Lx | 100000Lx |
| | ILLUMINANCE 2 | 100000Lx | 100000Lx | 100000Lx | 100000Lx | 100000Lx | 100000Lx |
| | SCALE | 4.8 | 4.8 | 4.8 | 4.8 | 4.8 | 4.8 |
| | EVALUATION | ◎ | ◎ | ◎ | ◎ | ◎ | ◎ |

DECORATION DEVICE, METHOD FOR USING LIGHT EMITTING DEVICE, AND VEHICLE

TECHNICAL FIELD

An embodiment of the present invention relates to a decoration device, a method for using a light emitting device, and a vehicle.

BACKGROUND

Recently, an effort for reducing energy consumption has been emphasized. From such a background, a light emitting diode (LED) having comparatively small power consumption has attracted attention as a next-generation light source. The LED has a small size and a small calorific value, and also has excellent responsiveness. For this reason, the LED has been widely used in various optical devices. For example, recently, alight emitting device including an LED arranged on a substrate having flexibility and translucency as a light source has been proposed.

It has been known that in a case where an object positioned on a rear side of the light emitting device is observed through such a type of light emitting device, the visibility of the object is changed according to a distance between the light emitting device and the object, or the background of the object. However, the visibility of the object has not been quantitatively represented.

Patent Document 1: JP 2012-084855 A

SUMMARY

The invention has been made in consideration of the circumstances described above, and an object thereof is to provide a novel method for using a light emitting device.

In order to attain the object described above, a decoration device according to this embodiment is a decoration device decorating an object used indoors, including: a light emitting device having light transmittivity and flexibility, including a plurality of light emitting elements emitting light from one surface and the other surface, and being arranged on one side of the object, in which a distance between the object and the light emitting device when an indoor light is turned off is less than or equal to 90 cm.

DETAILED DESCRIPTION

Hereinafter, one embodiment of the invention will be described by using the drawings. In the description, an XYZ coordinate system including an X axis, a Y axis, and a Z axis orthogonal to each other is used.

Figure 1:
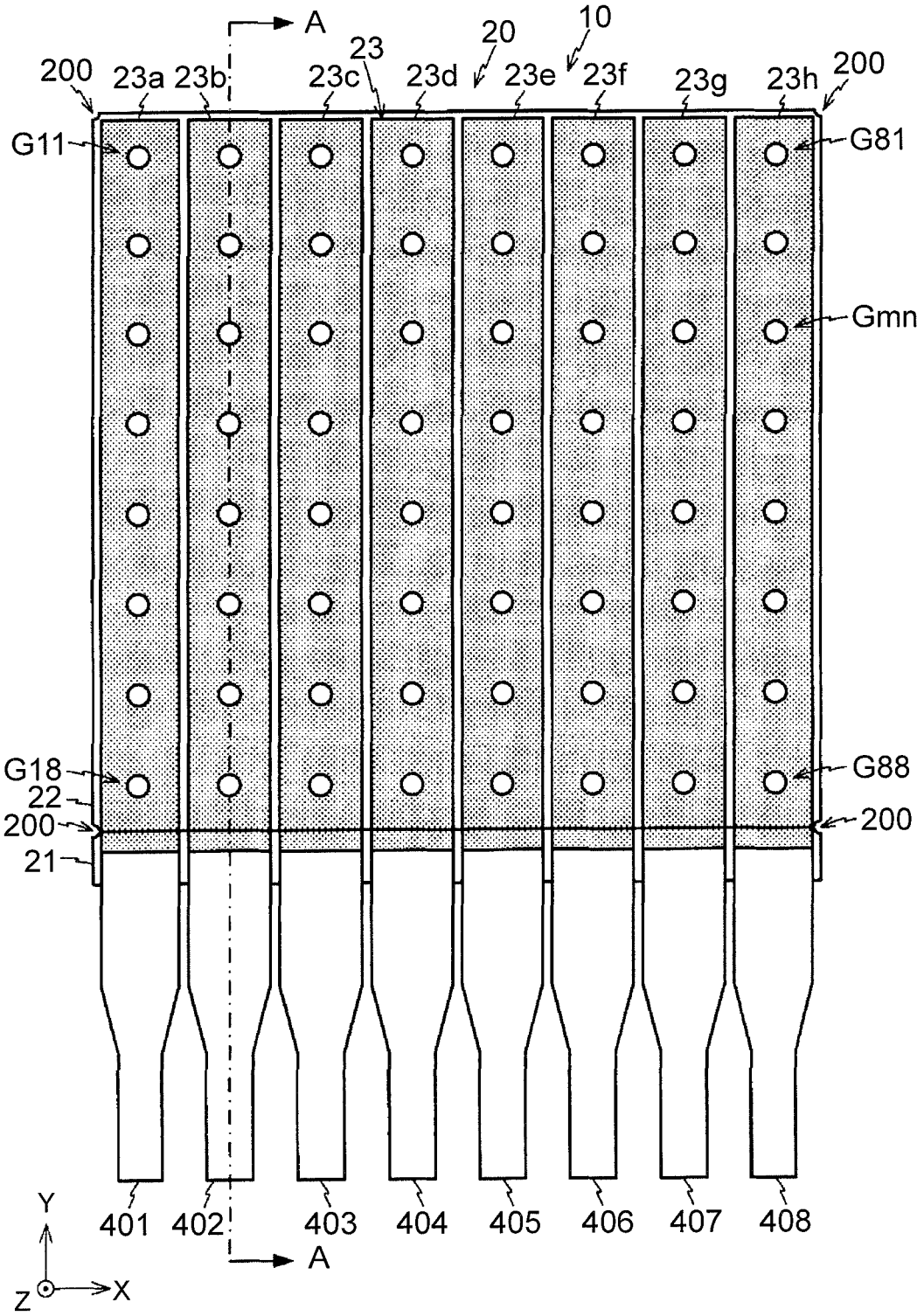
FIG. 1 is a plan view of a light emitting device according to this embodiment.

FIG. 1 is a plan view of a light emitting device 10 according to this embodiment. As illustrated in FIG. 1, the light emitting device 10 is a module in which a longitudinal direction is set to a Y axis direction. The light emitting device 10 includes a square light emitting panel 20, and eight flexible cables 401 to 408 that are connected to the light emitting panel 20.

Figure 2:
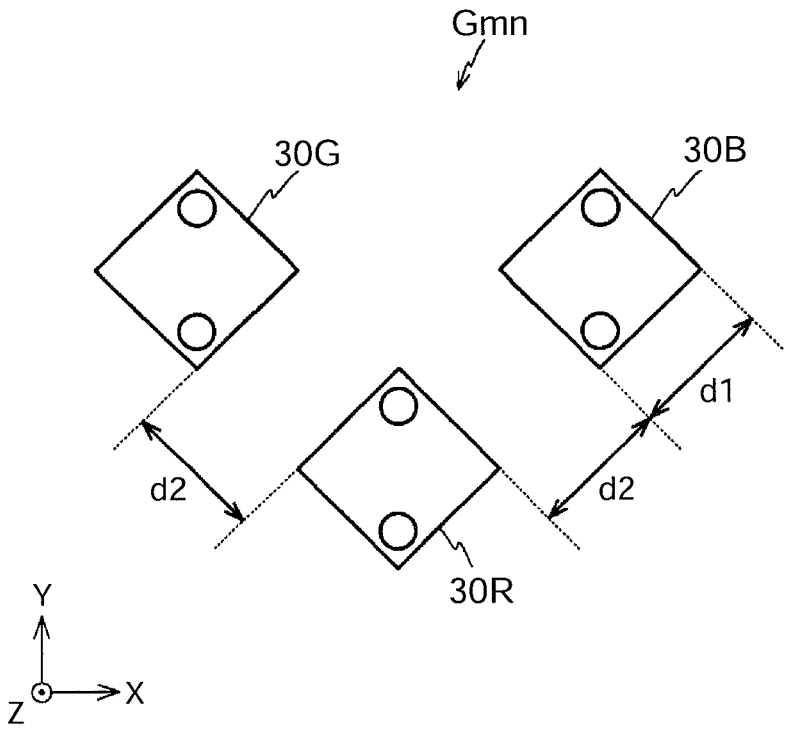
FIG. 2 is a plan view illustrating a point light source.

The light emitting panel 20 is a panel including 64 point light sources Gmn (=G11 to G88: m and n are an integer of 1 to 8) that are arranged into the shape of a matrix of eight rows and eight columns. The dimension of the light emitting panel 20 in an X axis direction and the Y axis direction is approximately 10 cm to 15 cm. FIG. 2 is a plan view illustrating the point light source Gmn. As illustrated in FIG. 2, the point light source Gmn includes three light emitting elements 30R, 30G, and 30B.

Each of the light emitting elements 30R, 30G, and 30B is a square LED chip of which one side is approximately 0.1 mm to 3 mm. In this embodiment, the light emitting elements 30R, 30G, and 30B are a bare chip. In addition, a light intensity of the light emitting elements 30R, 30G, and 30B is approximately 0.1 to 1 [lm]. Hereinafter, for the convenience of the description, the light emitting elements 30R, 30G, and 30B will be suitably and collectively referred to as a light emitting element 30.

Figure 3:
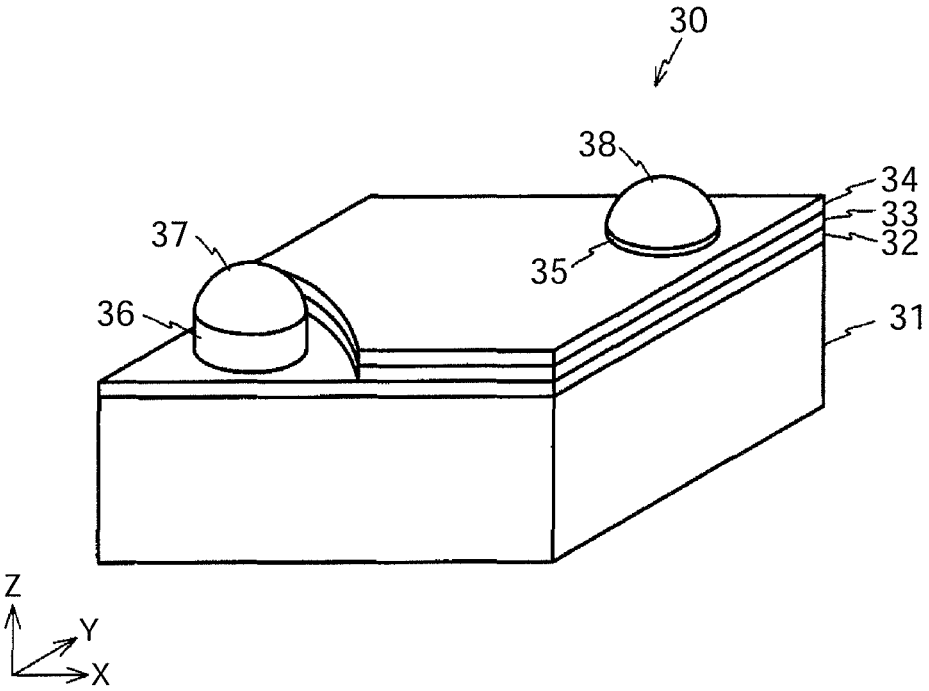
FIG. 3 is a perspective view illustrating an example of a light emitting element.

FIG. 3 is a perspective view illustrating an example of the light emitting element 30. As illustrated in FIG. 3, the light emitting element 30 is an LED chip including a base substrate 31, an N type semiconductor layer 32, an active layer 33, and a P type semiconductor layer 34. A rated voltage of the light emitting element 30 is approximately 2.5 V.

The base substrate 31, for example, is a square plate-like substrate formed of sapphire. The N type semiconductor layer 32 having the same shape of that of the base substrate 31 is formed on an upper surface of the base substrate 31. Then, the active layer 33 and the P type semiconductor layer 34 are laminated on an upper surface of the N type semiconductor layer 32, in this order. The N type semiconductor layer 32, the active layer 33, and the P type semiconductor layer 34 are formed of a compound semiconductor material. For example, in a light emitting element emitting red light, an InAlGaP-based semiconductor can be used as an active layer. In addition, in a light emitting element emitting blue or green light, a GaN-based semiconductor can be used as the P type semiconductor layer 34 and the N type semiconductor layer 32, and an InGaN-based semiconductor can be used as the active layer 33. In any case, the active layer may have a double hetero (DH) junction structure, or may have a multiquantum well (MQW) structure. In addition, the active layer may have a PN junction configuration.

In the active layer 33 and the P type semiconductor layer 34 that are laminated on the N type semiconductor layer 32, a notch is formed in a corner portion on a −Y side and a −X side. The surface of the N type semiconductor layer 32 is exposed from the notch of the active layer 33 and the P type semiconductor layer 34.

A pad electrode 36 that is electrically connected to the N type semiconductor layer 32 is formed in a region of the N type semiconductor layer 32 that is exposed from the active layer 33 and the P type semiconductor layer 34. In addition, a pad electrode 35 that is electrically connected to the P type semiconductor layer 34 is formed in a corner portion of the P type semiconductor layer 34 on a +X side and a +Y side. The pad electrodes 35 and 36 are formed of copper (Cu) or gold (Au), and bumps 37 and 38 are formed on an upper surface. The bumps 37 and 38 are a metal bump formed of a metal such as gold (Au) or a gold alloy. A solder bump that is molded into the shape of a half-sphere may be used instead of the metal bump. In the light emitting element 30, the bump 37 functions as a cathode electrode, and the bump 38 functions as an anode electrode.

The light emitting element 30R illustrated in FIG. 2 emits red light. In addition, the light emitting element 30G emits green light, and the light emitting element 30B emits blue light. Specifically, the light emitting element 30R allows light having a peak wavelength of approximately 600 nm to 700 nm to exit. In addition, the light emitting element 30G allows light having a peak wavelength of approximately 500 nm to 550 nm to exit. Then, the light emitting element 30B allows light having a peak wavelength of approximately 450 nm to 500 nm to exit.

In the light emitting elements 30R, 30G, and 30B configured as described above, the light emitting elements 30G and 30B are arranged to be adjacent to light emitting element 30R. In addition, the light emitting elements 30R, 30G, and 30B are arranged to be close to each other such that a distance d2 to the adjacent light emitting elements 30R, 30G, and 30B is less than or equal to a width d1 of the light emitting elements 30R, 30G, and 30B.

Figure 4:
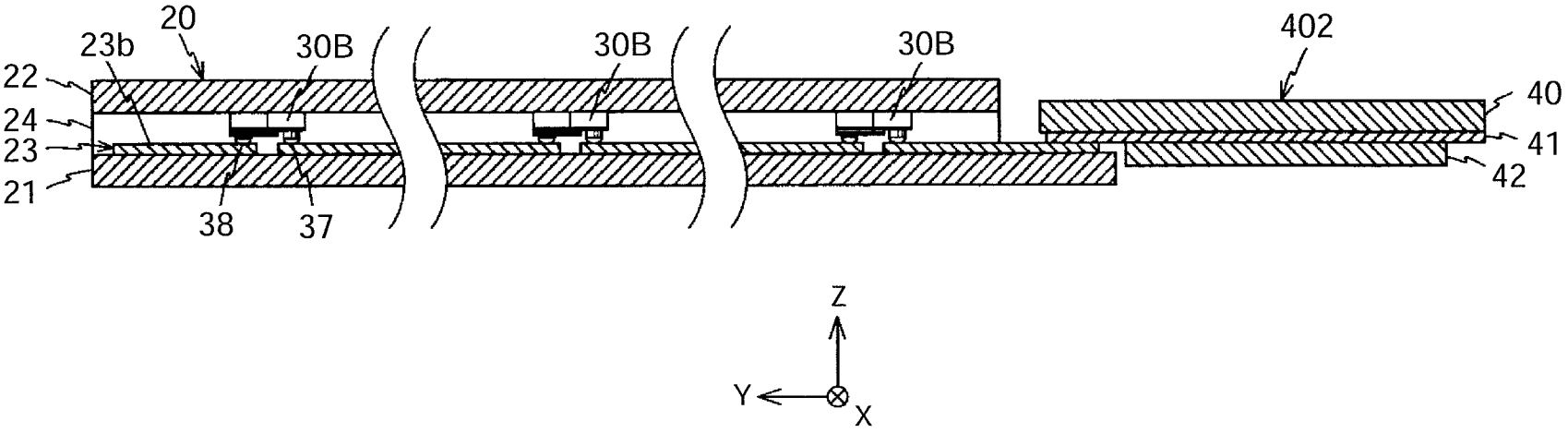
FIG. 4 is a diagram illustrating an A-A sectional surface of the light emitting device.

FIG. 4 is a diagram illustrating an A-A sectional surface of the light emitting device 10 in FIG. 1. As known with reference to FIG. 4, the light emitting panel 20 configuring the light emitting device 10 includes the light emitting elements 30R, 30G, and 30B described above, a set of substrates 21 and 22, and a resin layer 24 that is formed between the substrates 21 and 22. Furthermore, FIG. 4 illustrates only the light emitting element 30B.

The substrate 21 is a film-like member in which the longitudinal direction is set as the Y axis direction. In addition, the substrate 22 is a square film-like member. The substrates 21 and 22 have a thickness of approximately 50 μm to 300 μm, and have transmittivity with respect to visible light. It is preferable that a total light transmittance of the substrates 21 and 22 is approximately 5% to 95%. Furthermore, the total light transmittance indicates a total light transmittance that is measured on the basis of Japanese Industrial Standards JISK7375:2008.

The substrates 21 and 22 have flexibility, and have a bending elastic modulus of approximately 0 kgf/mm$^2$ to 320 kgf/mm$^2$ (excluding 0). Furthermore, the bending elastic modulus is a value that is measured by a method based on ISO178 (JIS K7171:2008).

It is considered that polyethylene terephthalate (PET), polyethylene naphthalate (PEN), polycarbonate (PC), polyethylene succinate (PES), ARTON, an acrylic resin, and the like are used as a material of the substrates 21 and 22.

In the set of substrates 21 and 22 described above, a conductor layer 23 having a thickness of approximately 0.05 μm to 10 μm is formed on an upper surface of the substrate 21 (a surface on a −Z side in FIG. 4). The conductor layer 23, for example, is a vapor-deposited film or a sputtering film. In addition, the conductor layer 23 may be formed by pasting a metal film with an adhesive agent. In a case where the conductor layer 23 is the vapor-deposited film or the sputtering film, the thickness of the conductor layer 23 is approximately 0.05 μm to 2 μm. In a case where the conductor layer 23 is the pasted metal film, the thickness of the conductor layer 23 is approximately 2 μm to 10 μm or 2 μm to 7 μm.

Figure 5:
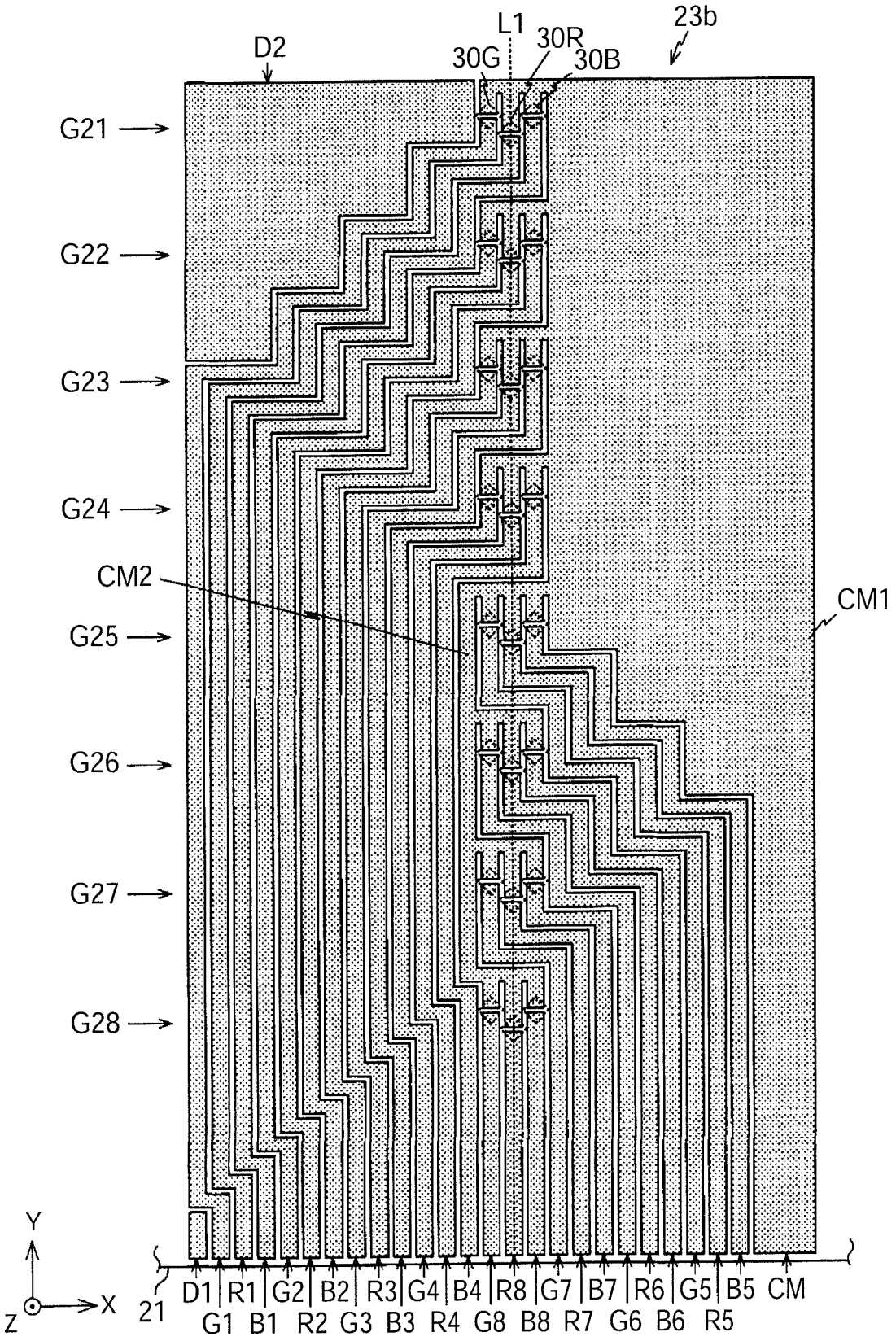
FIG. 5 is a plan view of a conductor pattern.

The conductor layer 23 is a metal layer formed of a metal material such as copper (Cu) or silver (Ag). As illustrated in FIG. 1, the conductor layer 23 is configured of eight conductor patterns 23*a* to 23*h* in which the longitudinal direction is set to the Y axis direction. FIG. 5 is a plan view of the conductor pattern 23*b* illustrated in FIG. 4. As illustrated in FIG. 5, the conductor pattern 23*b* includes 24 individual line patterns G1 to G8, R1 to R8, and B1 to B8, a common line pattern CM, and two dummy line patterns D1 and D2.

In the individual line patterns G1 to G8, one end is connected to each cathode of the light emitting element 30G configuring each of point light sources G21 to G28. Then, the other end is drawn around in an end portion of the substrate 21 on the −Y side. Similarly, in the individual line patterns R1 to R8, one end is connected to each cathode of the light emitting element 30R configuring each of the point light sources G21 to G28. Then, the other end is drawn around in the end portion of the substrate 21 on the −Y side. In addition, in the individual line patterns B1 to B8, one end is connected to each cathode of light emitting element 30B configuring each of the point light sources G21 to G28. Then, the other end is drawn around in the end portion of the substrate 21 on the −Y side.

In the common line pattern CM, one end is branched into plurality of ends, and is connected to each anode of the light emitting elements 30R, 30G, and 30B configuring each of the point light sources G21 to G28. In addition, the other end is drawn around in the end portion of the substrate 21 on the −Y side. The common line pattern CM mainly includes a wide main portion CM1 that is positioned on the +X side of the individual line pattern B5, and a branch portion CM2 that is branched from the main portion CM1.

In the conductor pattern 23*b*, the individual line patterns G1 to G8, R1 to R8, and B1 to B8 are respectively connected to the point light sources G21 to G28 that are arranged along a straight line L1 parallel to the Y axis, the individual line patterns G1 to G4, R1 to R4, and B1 to B4 are drawn around on the −X side of the straight line L1, and the individual line patterns G5 to G8, R5 to R8, and B5 to B8 are drawn around on the +X side of the straight line L1. Then, the branch portion CM2 is arranged to be interposed between the individual line patterns G1 to G4, R1 to R4, and B1 to B4 and the individual line patterns G5 to G8, R5 to R8, and B5 to B8.

In addition, the dummy line patterns D1 and D2 are formed in a region in which the individual line pattern and the common line pattern are not arranged.

Figure 6:
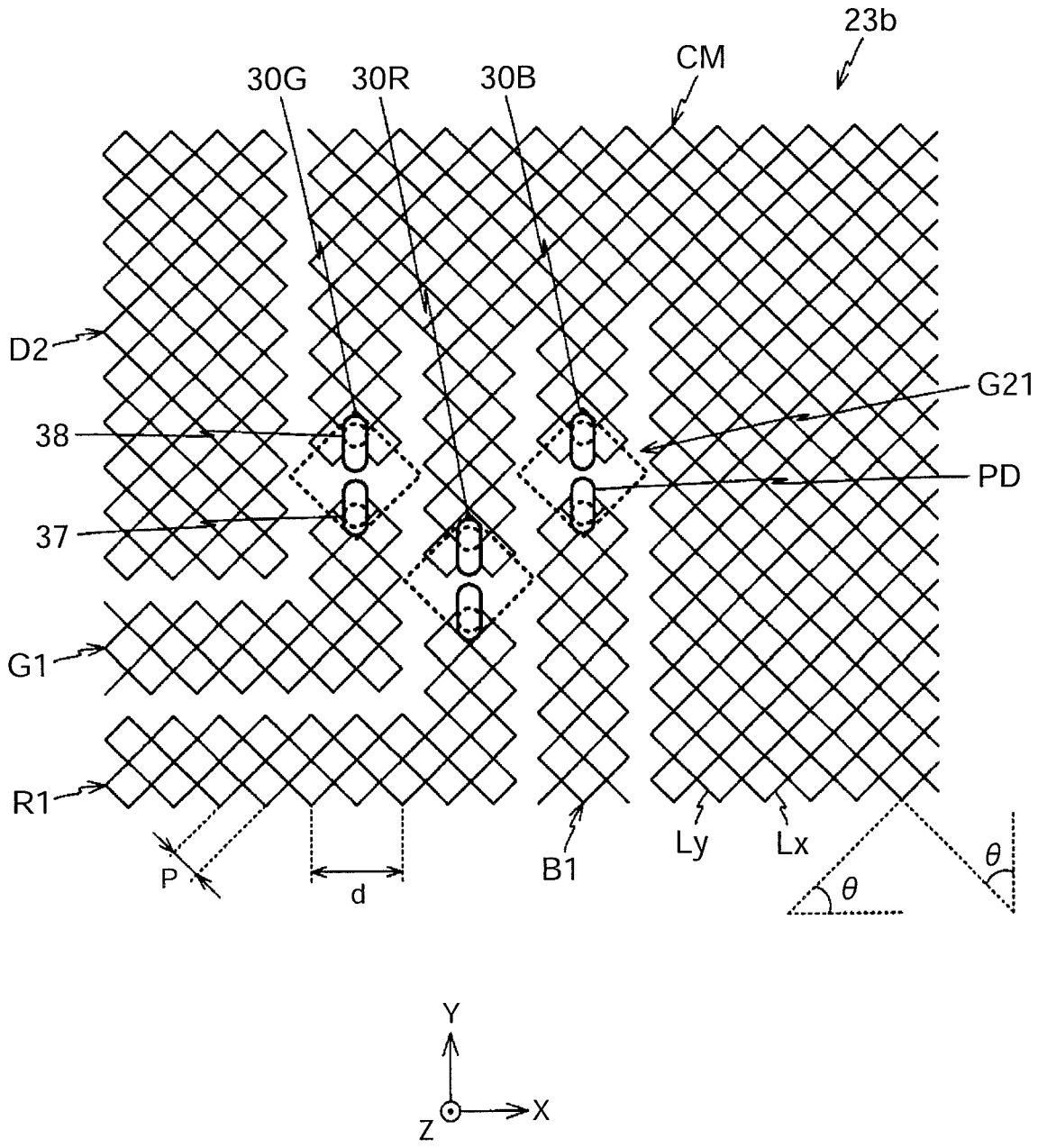
FIG. 6 is a diagram enlargedly illustrating the vicinity of the point light source.

The individual line patterns G1 to G8, R1 to R8, and B1 to B8, the common line pattern CM, and the dummy line patterns D1 and D2 are formed of a mesh pattern. FIG. 6 is a diagram enlargedly illustrating the vicinity of the point light source G21. As known with reference to FIG. 6, the individual line patterns G1, R1, and B1, the common line pattern CM, and the dummy line pattern D2 include a line Lx having an angle of 45 degrees with respect to the X axis, and a line Ly having an angle of 45 degrees with respect to the Y axis.

In the lines Lx and Ly, a line width is approximately 5 μm. In addition, an array pitch P of the lines Lx and Ly is approximately 150 μm. In the individual line patterns G1, R1, and B1, and the common line pattern CM, a connection pad PD to which the bumps 37 and 38 of the light emitting elements 30R, 30G, and 30B are connected is formed. In the light emitting elements 30R, 30G, and 30B, the bumps 37 and 38 are connected to the connection pad PD, and thus, the light emitting elements 30R, 30G, and 30B are electrically connected to the individual line patterns G1, R1, and B1, and the common line pattern CM.

As with the conductor pattern 23*b* described above, the conductor patterns 23*a*, and 23*c* to 23*h* illustrated in FIG. 1 also include 24 individual line patterns G1 to G8, R1 to R8, and B1 to B8, the common line pattern CM, and two dummy line patterns D1 and D2.

Returning to FIG. 4, the resin layer 24 is an insulator that is formed between the substrate 21 and the substrate 22. The resin layer 24, for example, is formed of a thermosetting resin or a thermoplastic resin having translucency. An epoxy-based resin, an acrylic resin, a styrene-based resin, an ester-based resin, a urethane-based resin, a melamine resin, a phenolic resin, an unsaturated polyester resin, a diallyl phthalate resin, and the like are known as the thermosetting resin. A polypropylene resin, a polyethylene resin, a polyvinyl chloride resin, an acrylic resin, a Teflon (Registered Trademark) resin, a polycarbonate resin, an acrylonitrile butadiene styrene resin, a polyamide imide resin, and the like are known as the thermoplastic resin. Among them, the epoxy-based resin is excellent in fluidity at the time of softening, adhesiveness after hardening, weather resistance, and the like, in addition to translucency, electric insulating, flexibility, and the like, and thus, is preferable as a configuration material of the resin layer 24.

As illustrated in FIG. 4, in the light emitting panel 20 configured as described above, the length of the substrate 22 in the Y axis direction is shorter that of the substrate 21. For this reason, the conductor layer 23 is in a state where an end portion on the −Y side is exposed.

A flexible cable 402 is a wiring substrate having flexibility in which the longitudinal direction is set to the Y axis direction. As illustrated in FIG. 1, the flexible cable 402 is formed into a tapered shape in which a width (a dimension in the X axis direction) decreases from an end on the +Y side towards an end on the −Y side.

As illustrated in FIG. 4, the flexible cable 402, for example, is formed of a material such as polyimide, and includes a base substrate 40 having insulating properties and flexibility, a conductor pattern 41 that is connected to the conductor layer 23 of the light emitting panel 20, and a coverlay 42 that covers the conductor pattern 41. The conductor pattern 41 covered with the coverlay 42 is in a state where only both end portions in the Y axis direction are exposed. The conductor pattern 41 includes a plurality of lines. Such lines will be described below.

As illustrated in FIG. 4, in the flexible cable 402, a lower surface in an end portion of the base substrate 40 on the +Y side adheres to an upper surface in an end portion of the substrate 21 on the −Y side configuring the light emitting panel 20, by an anisotropically conductive adhesive agent. As illustrated in FIG. 1, the flexible cable 402 adheres to the light emitting panel 20 such that the conductor pattern 23*b* of the light emitting panel 20 overlaps with the flexible cable 402.

Figure 7:
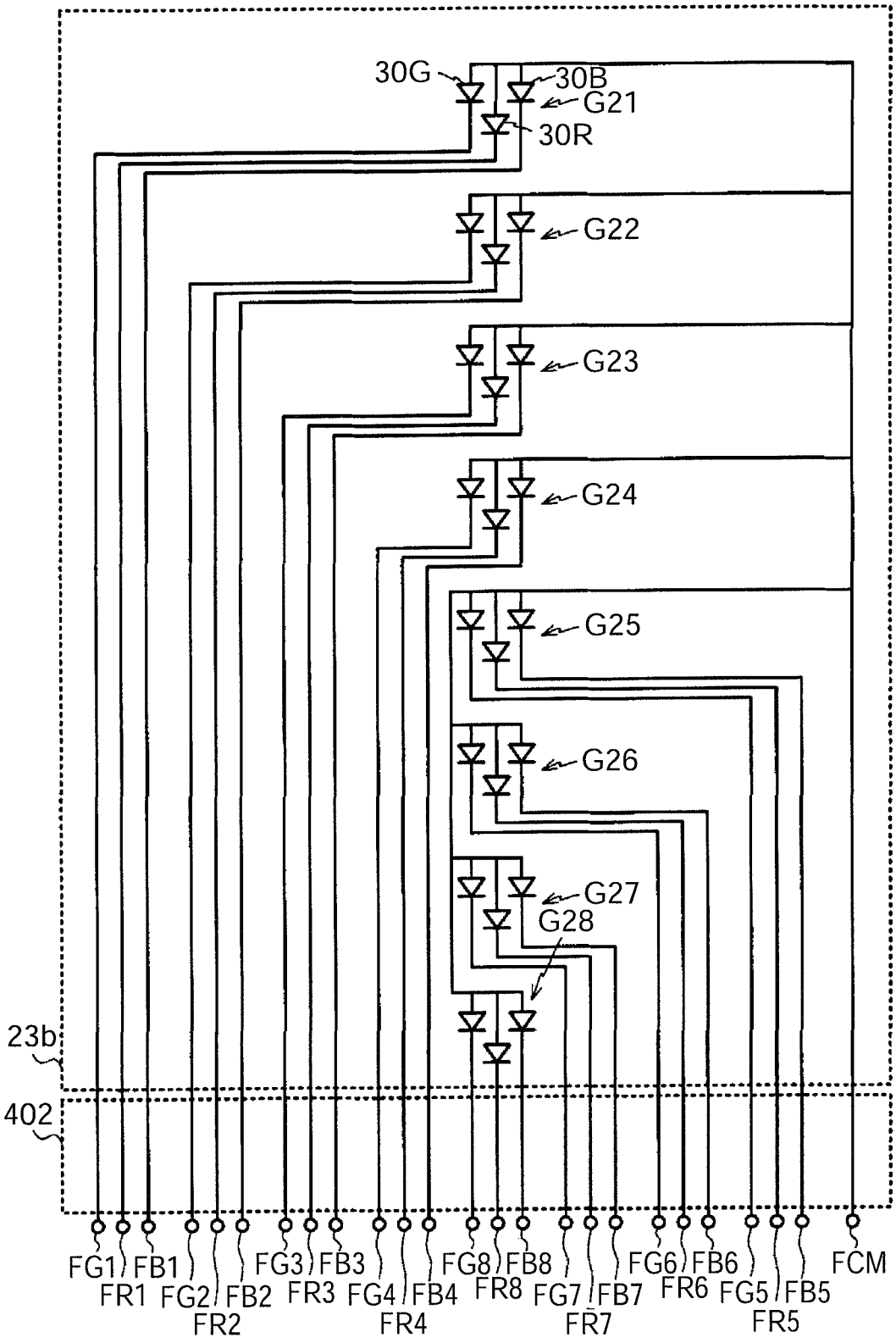
FIG. 7 is a diagram illustrating a circuit formed by allowing a flexible cable to adhere to a light emitting panel.

FIG. 7 is a diagram illustrating a circuit that is formed by allowing the flexible cable 402 to adhere to the light emitting panel 20. As illustrated in FIG. 7, 25 lines FG1 to FG8, FR1 to FR8, FB1 to FB8, and FCM are formed in the flexible cable 402. Each of the lines FG1 to FG8, FR1 to FR8, and FB1 to FB8 of the flexible cable 402 is connected to the cathode of the light emitting elements 30G, 30R, and 30B configuring the point light sources G21 to G28. In addition, the line FCM of the flexible cable 402 is connected to all of the anodes of the light emitting elements 30G, 30R, and 30B configuring the point light sources G21 to G28.

The flexible cables 401, and 403 to 408 have the same configuration as that of the flexible cable 402 described above. As illustrated in FIG. 1, each of the flexible cables 401, and 403 to 408 adheres to the light emitting panel 20 such that the conductor patterns 23*a*, and 23*c* to 23*h* of the light emitting panel 20 overlap with the flexible cables 401, and 403 to 408. An anisotropically conductive adhesive agent is used in the adhesion with respect to the light emitting panel 20.

In the light emitting device 10 configured as described above, a voltage is selectively applied between the lines FG1 to FG8, FR1 to FR8, and FB1 to FB8 of the flexible cables 401 to 408, and the line FCM, and thus, it is possible to individual turn on the light emitting elements 30R, 30G, and 30B configuring the point light source Gmn.

Figure 8:
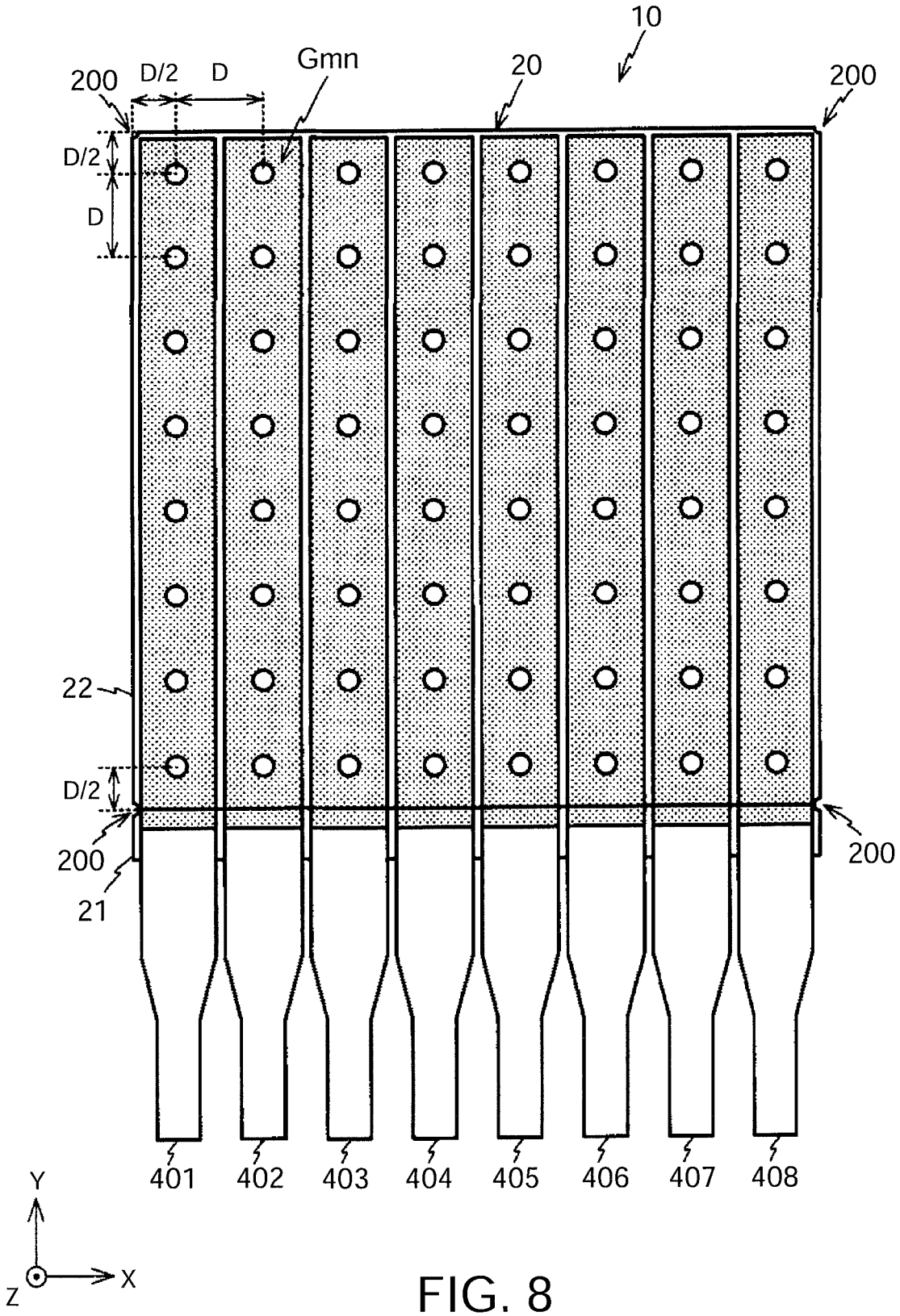
FIG. 8 is a diagram for illustrating an array of the point light sources.

FIG. 8 is a diagram for illustrating an array of the point light sources Gmn. As illustrated in FIG. 8, in the light emitting device 10, a circular notch 200 is provided in a corner portion of the substrate 22. In addition, each of the point light sources Gmn is arrayed such that an array pitch in the X axis direction and the Y axis direction is D, and a distance from an outer edge of the substrate 22 configuring the light emitting panel 20 to the closest point light source Gmn is D/2. Specifically, the array pitch D is greater than or equal to 0.3 cm and less than or equal to 3.2 cm.

Figure 9:
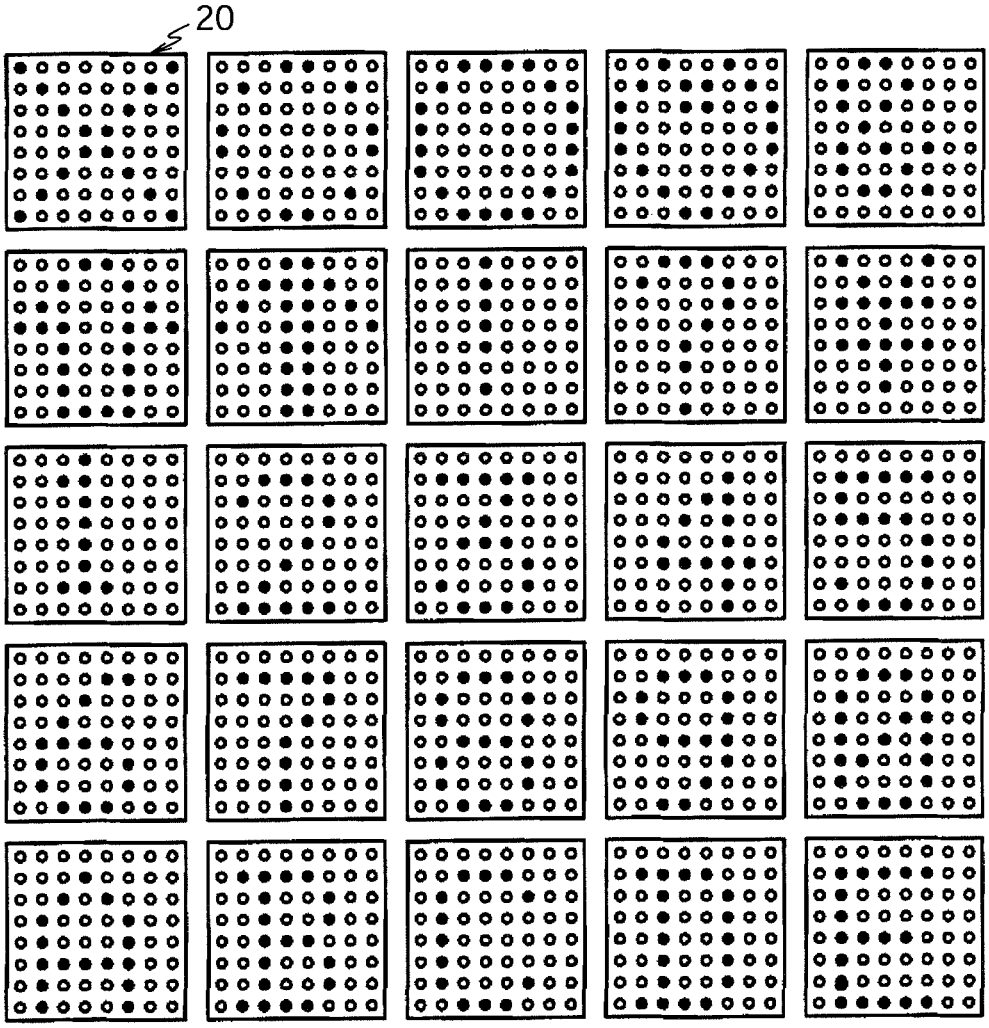
FIG. 9 is a diagram illustrating a text that is displayed on the light emitting panel.

FIG. 9 is a diagram illustrating a text that is displayed on the light emitting panel 20. In the light emitting device 10, the point light source Gmn of the light emitting panel 20 is selectively turned on, and thus, it is possible to display various patterns.

Figure 10:
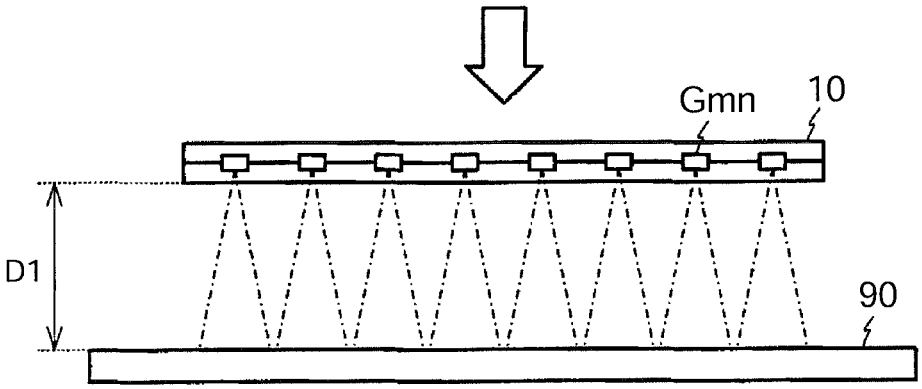
FIG. 10 is a diagram for describing a change in visibility of an object.
Figure 11:
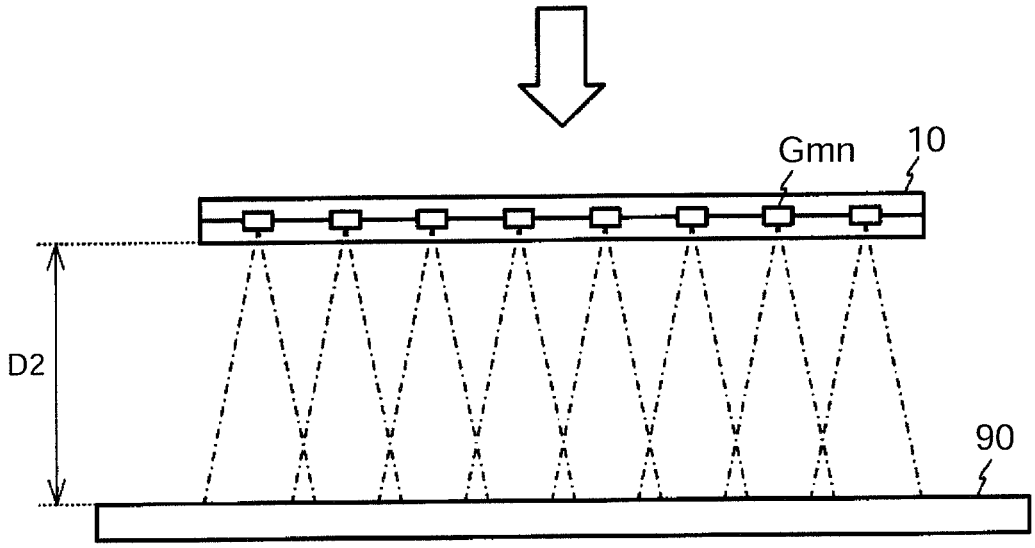
FIG. 11 is a diagram for describing the change in the visibility of the object.

As illustrated in FIG. 10, the inventors or the like find that when an object 90 positioned on a back surface is observed through the light emitting device 10 in which the point light source Gmn is turned on, in a room where an illuminance is turned off, the visibility of the object is changed according to a distance D1 between the light emitting device 10 and the object 90. This is because, for example, as illustrated in FIG. 11, in a case where the distance between the light emitting device 10 and the object 90 D2 (>D1) that is greater than D1, the light emitting device 10 on a near side stands out. For this reason, it is considered that a focal point of eyes is focused on the point light source Gmn of the light emitting device, and as a result thereof, it is difficult to observe the object 90. In addition, it is also considered that the point light source Gmn causes a glare phenomenon. In addition, there is a biological individual difference in a function or a sensitivity, and a focal point depth of the eyes, according to an age or an individual difference of an observer. For this reason, it is considered that it is difficult for a specific observer to observe the object. In addition, a unique structure of this light emitting device is also considered as a factor that makes the observation of the object difficult. As described above, the reason that the visibility decreases at the time of observing the object through the light emitting device 10 that is turned on is variously considered, and there is no obvious factor in the current situation.

Figure 27:
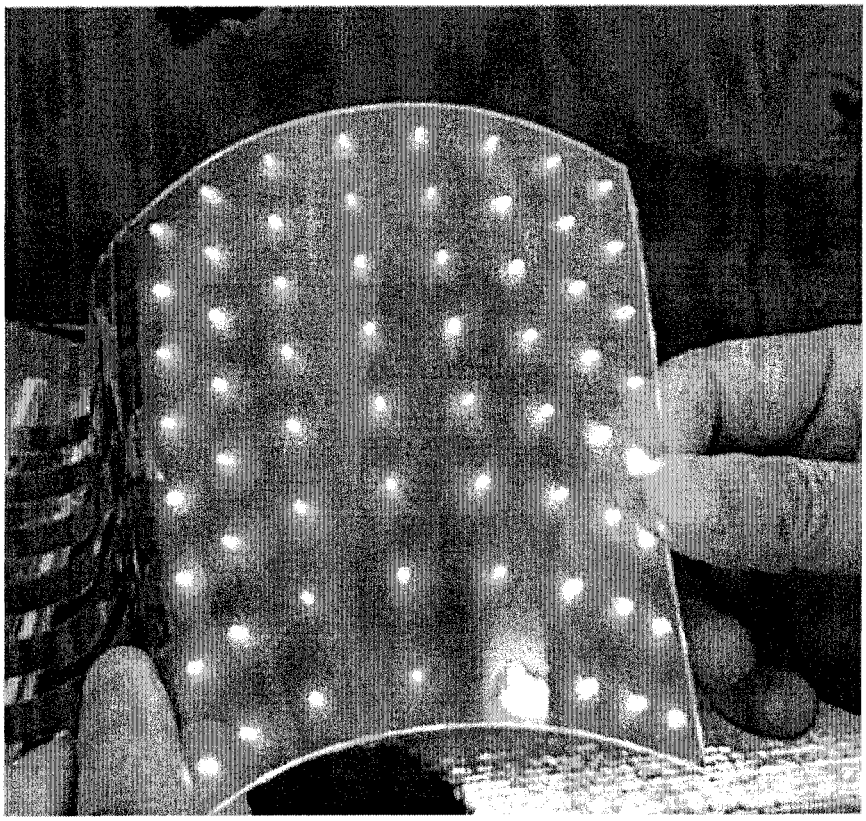
FIG. 27 is a picture of the light emitting device.

Therefore, an organoleptic examination using the light emitting device 10 is performed. In the light emitting device 10 used in the organoleptic examination, the array pitch of 64 point light sources Gmn is 14.6 mm, and the point light sources Gmn are arranged into the shape of a matrix of eight rows and eight columns. In the size of the light emitting panel 20, one side is 117 mm, and the thickness of the substrates 21 and 22 is 100 μm. Only the light emitting element 30R of the point light source Gmn is turned on. The light emitting device 10 is in a state of being an approximately flat surface, and for example, as known with reference to a picture of FIG. 27, in a state of being bent into the shape of a curved surface having a radius of 30 cm. In addition, the organoleptic examination is performed in one room of a commercial building that is identical to the environment of a site where the light emitting device 10 is used.

Figure 12:
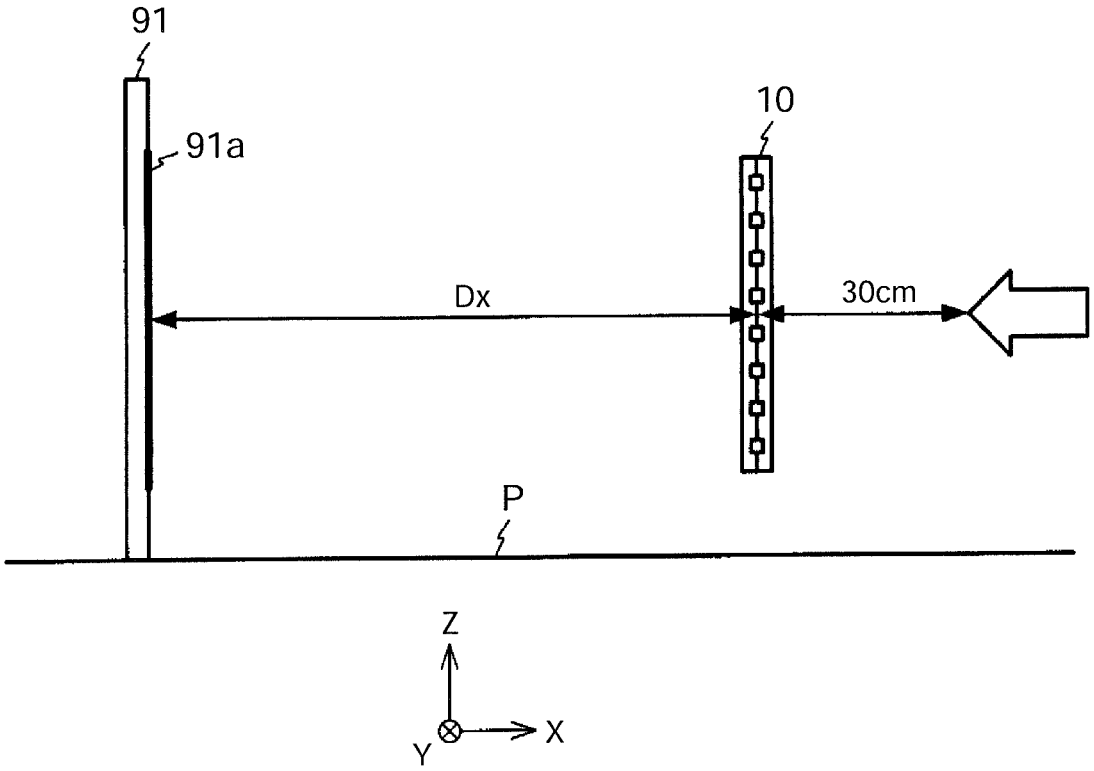
FIG. 12 is a diagram for describing arrangement of a test target and the light emitting device.

As illustrated in FIG. 12, a plate-like test target 91 and the light emitting device 10 are arranged on a horizontal surface P along a straight line parallel to the X axis. For example, paper 91*a* of A4 on which a test pattern is printed is stuck to the surface of the test target 91.

Figures 13, 14:
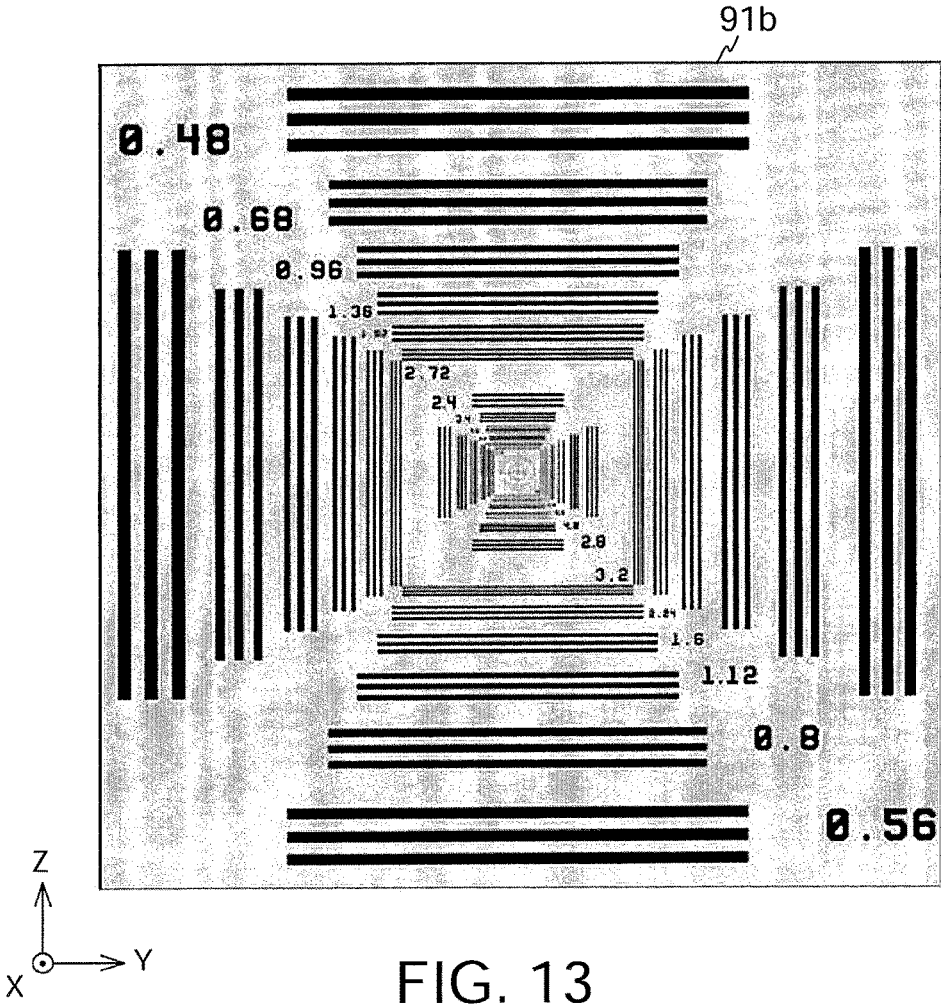
FIG. 13 is a diagram illustrating a test pattern printed on paper.
FIG. 14 is a diagram illustrating an observation result of the test target.

FIG. 13 illustrates a test pattern 91*b* that is printed on the paper 91*a*. In the test pattern 91*b*, the size of an NBS192 resolving power test target is doubled in the Y axis direction and the Z axis direction. The test pattern 91*b*, for example, includes a line in a vertical direction and a line in a horizontal direction. The dimension of the test pattern 91*b* in the Y axis direction and the Z axis direction is 152.4 mm.

In the organoleptic examination, an indoor illuminance is measured with an illuminance meter provided in the vicinity of the test target 91, and the test target 91 is observed from a position separated from the light emitting device 10 to the +X side by a distance of 30 cm through the light emitting device 10. The test target 91 is observed by changing a distance Dx between the test target 91 and the light emitting device 10 to 0 cm, 30 cm, 60 cm, 90 cm, 120 cm, and 150 cm. The organoleptic examination described above is performed by observing a doll instead of the test target 91. In addition, the illuminance meter is a smart phone Galaxy S7 edge manufactured by Samsung Electronics Co., Ltd., and an illuminance meter that is realized by executing an application Luxmeter is used by being corrected.

In an observation result, three observers visually observe the test target 91 through the light emitting device 10, and evaluate the visibility. For example, when the majority of the observers determine that there is visibility, it is concluded that there is visibility.

Table 1 illustrated in FIG. 14 shows a result of observing the test target 91 in a state where an indoor light is turned off. Illuminance 1 of Table 1 represents an indoor brightness that is measured without turning on the light emitting device 10. In addition, Illuminance 2 represents an indoor brightness that is measured by turning on the light emitting device 10. A scale is a numerical value applied to each line of the test pattern 91*b* illustrated in FIG. 13. In Table 1, it is shown that a line corresponding to the scale, or a line smaller than the scale is visible for three observers.

In addition, in a case where the visibility of the test pattern 91*b* is compared to the visibility of the doll, when a line having a scale of less than 0.8 is visible, the doll is obviously visible. Such a result is represented by ⊙. When a line having a scale of greater than or equal to 0.8 and less than 0.56 is visible, the doll can be excellently visually confirmed. Such a result is represented by ○. When a line having a scale of 0.56 is visible, the doll can be visually confirmed. Such a result is represented by Δ. When a line is not visible, the doll is not also capable of being visually confirmed. Such a result is represented by X.

As shown in Table 1 described above, when the indoor light is turned off, and a distance Dx between the test target 91 and the light emitting device 10 is 0 cm and 30 cm, the test pattern 91*b* is obviously visible. Therefore, when the indoor brightness is approximately 100 [lx], the distance Dx between the test target 91 and the light emitting device 10 is greater than or equal to 0 cm and less than or equal to 30 cm, and thus, it is possible to make the display of the light emitting device 10 and the visibility of the object optimally compatible. Furthermore, the brightness of a night arcade is approximately 150 [lx] to 200 [lx]. In addition, a brightness under a street lamp is approximately 50 [lx] to 100 [lx]. For this reason, a room of 100 [lx] has a brightness equivalent to that in the night arcade or under the street lamp. The inventors or the like consider that in a case where the brightness is 50 [lx] to 200 [lx], the object within 30 cm from the light emitting device 10 is excellently visible, and the object within 90 cm is visible.

In addition, when the distance Dx between the test target 91 and the light emitting device 10 is 60 cm, the test pattern 91*b* is obviously visible. Therefore, when the indoor brightness is approximately 100 [lx], the distance Dx between the test target 91 and the light emitting device 10 is less than or equal to 60 cm, and thus, it is possible to make the display of the light emitting device 10 and the visibility of the object excellently compatible.

In addition, when the distance Dx between the test target 91 and the light emitting device 10 is 90 cm, the test pattern 91*b* is visible. Therefore, when the indoor brightness is approximately 100 [lx], it is possible to make the display of the light emitting device 10 and the visibility of the object approximately compatible insofar as the distance Dx between the test target 91 and the light emitting device 10 is less than or equal to 90 cm.

Figures 15, 16, 17:
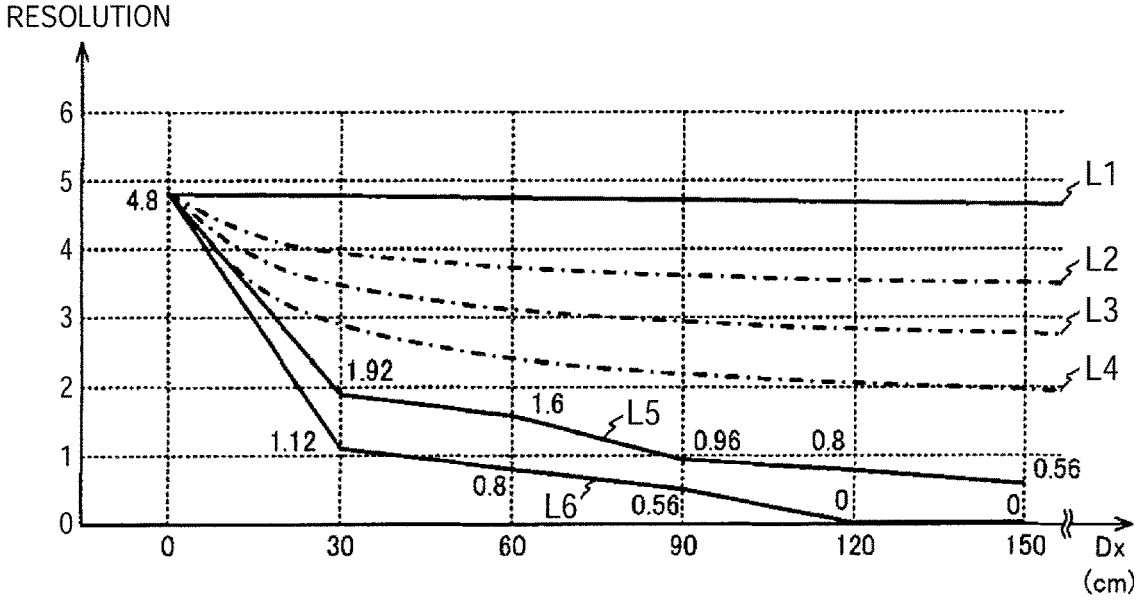
FIG. 15 is a diagram illustrating the observation result of the test target.
FIG. 16 is a diagram illustrating the observation result of the test target.
FIG. 17 is a graph showing a resolution with respect to a distance between the light emitting device and the object.

Table 2 illustrated in FIG. 15 shows a result of observing the test target 91 in a state where the indoor light is turned on. As shown in Table 2 described above, when the indoor light is turned on, and the distance Dx between the test target 91 and the light emitting device 10 is 0 cm, 30 cm, 60 cm, and 90 cm, the test pattern 91*b* is obviously visible. Therefore, when the indoor brightness is approximately 456 [lx], the distance Dx between the test target 91 and the light emitting device 10 is greater than or equal to 0 cm and less than or equal to 90 cm, and thus, it is possible to make the display of the light emitting device 10 and the visibility of the object optimally compatible. Furthermore, the brightness of a sales floor in a department store is approximately 500 [lx] to 700 [lx]. In addition, a brightness in a commercial office is approximately 400 [lx] to 700 [lx]. For this reason, a room of 456 [lx] has a brightness equivalent to that in the sales floor of the department store or in the office.

In addition, when the distance Dx between the test target 91 and the light emitting device 10 is 120 cm, the test pattern 91*b* is excellently visible. Therefore, when the indoor brightness is approximately 456 [lx], the distance Dx between the test target 91 and the light emitting device 10 is less than or equal to 120 cm, and thus, it is possible to make the display of the light emitting device 10 and the visibility of the object excellently compatible.

In addition, the distance Dx between the test target 91 and the light emitting device 10 is 150 cm, the test pattern 91*b* is visible. Therefore, when the indoor brightness is approximately 456 [lx], the distance Dx between the test target 91 and the light emitting device 10 is less than or equal to 150 cm, and thus, it is possible to make the display of the light emitting device 10 and the visibility of the object approximately compatible.

Figure 28:
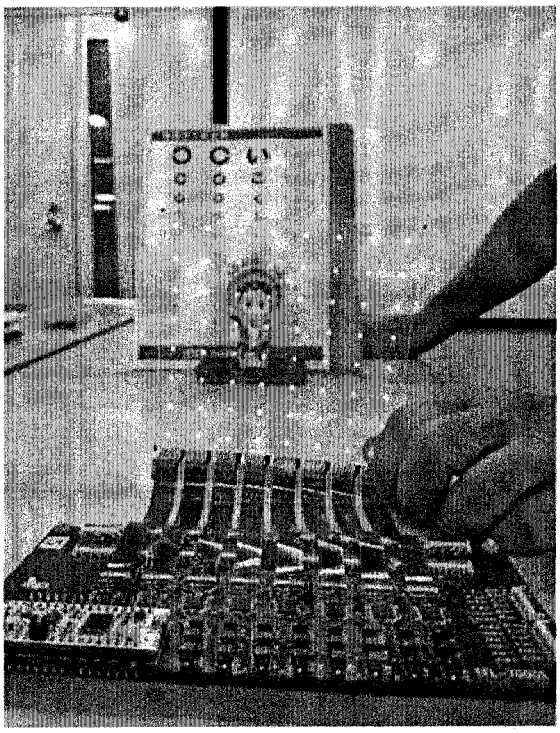
FIG. 28 is a picture of the light emitting device and the object.
Figure 29:
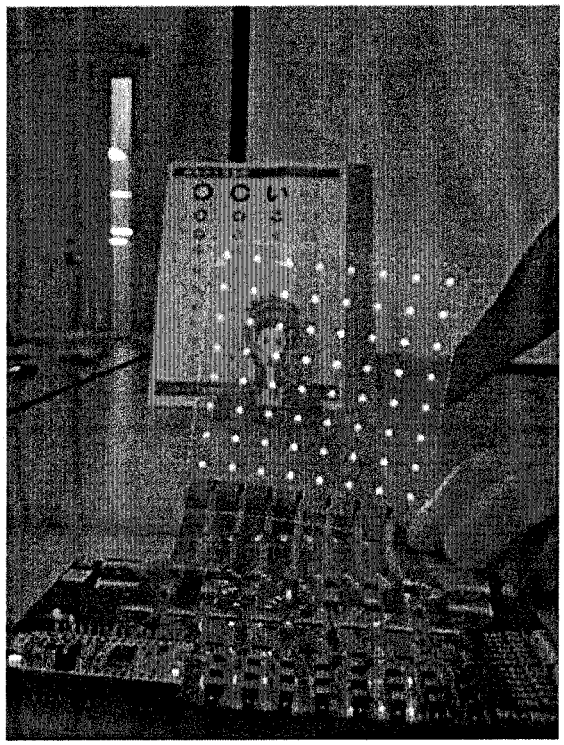
FIG. 29 is a picture of the light emitting device and the object.
Figure 30:
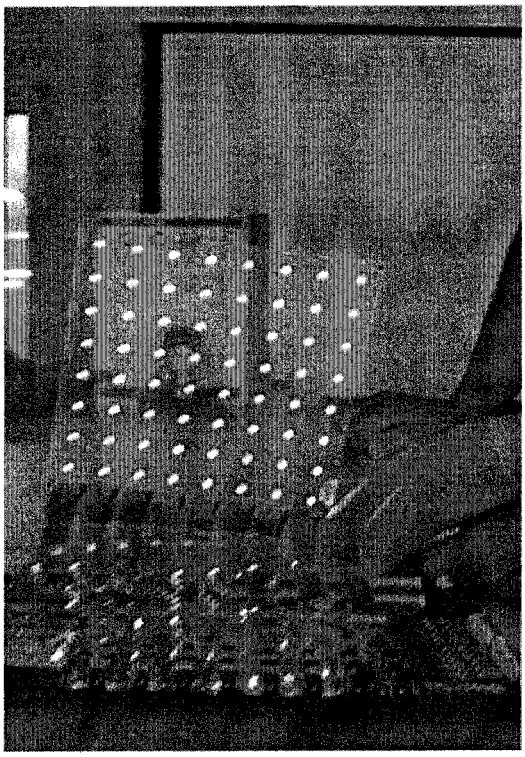
FIG. 30 is a picture of the light emitting device and the object.

For example, a state represented by ⊙ is a state in which the object (the doll and a visual acuity chart) is obviously visible, as illustrated in a picture of FIG. 28. At this time, the distance Dx between the object and the light emitting device 10 is approximately 30 cm, and the indoor light is turned on. A state represented by ○ is a state in which the object is approximately visible, as illustrated in a picture of FIG. 29. At this time, the distance Dx between the object and the light emitting device 10 is approximately 60 cm, and the indoor light is turned off. A state represented by X is a state in which the object is not visible, as illustrated in a picture of FIG. 30. At this time, the distance Dx between the object and the light emitting device 10 is approximately 120 cm, and the indoor light is turned off.

Table 3 illustrated in FIG. 16 shows a result of observing the test target 91 outdoors in fine weather. As illustrated in Table 3 described above, the distance Dx is all distances of 0 cm to 150 cm, and the test pattern 91*b* of the test target 91 is obviously visible outdoors.

In addition, in a case where an outdoor building or the like is observed through the light emitting device 10 that is turned on, the scenery of the building or the like can be visually confirmed finely to the same extent that there is no light emitting device 10. Furthermore, such a test is performed at 1 p.m. in fine weather of summer. An ambient illuminance of the building as the object is assumed to be 100000 [lx]. In addition, in the light emitting device 10, the light emitting elements 30R, 30G, and 30B are turned on in various combinations, but there is no different in the results.

FIG. 17 is a graph showing a resolution with respect to the distance Dx between the light emitting device 10 and the object. Furthermore, the resolution is based on the value of the scale illustrated by the test pattern 91*b*. Each of curves L1 and L2 is obtained by using the ambient illuminance as the background as a parameter. For example, the curve L1 represents a resolution with respect to the distance Dx when the ambient illuminance of the object that is observed through the light emitting device 10 is the illuminance (100000 [lx]) of solar light. A curve L5 represents a resolution with respect to the distance Dx when the ambient illuminance of the object that is observed through the light emitting device 10 is the illuminance (456 [lx]) of the indoor light. A curve L6 represents a resolution with respect to the distance Dx when the ambient illuminance of the object that is observed through the light emitting device 10 is an illuminance (100 [lx]) in a room where an indoor light is turned off. In addition, curves L2, L3, and L4 represent a resolution with respect to the distance Dx when the ambient illuminance of the object is 2000 [lx], 1000 [lx], and 800 [lx]. The curves L2, L3, and L4 are a curve obtained by assumption. For example, a brightness of 2000 [ix] is approximately identical to a brightness in one hour after sunrise in cloudy weather. In addition, a brightness of 1000 [lx] is approximately identical to a brightness in one hour before sunset in fine weather. In addition, a brightness of 800 [lx] is approximately identical to the brightness of a reading light.

Figure 18:
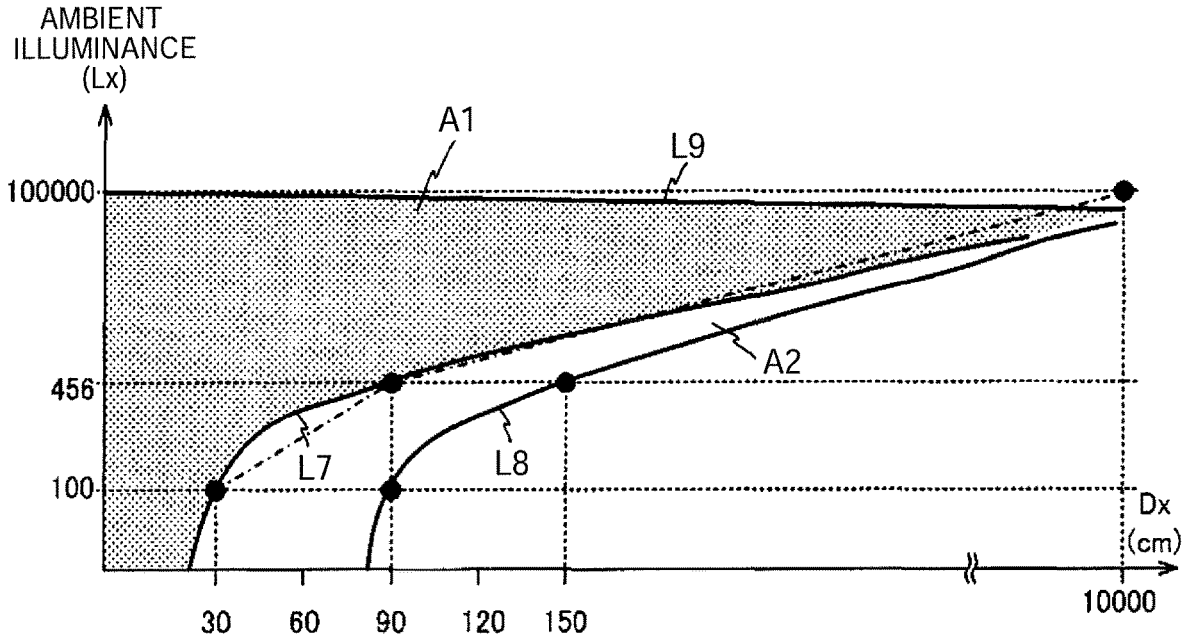
FIG. 18 is a graph showing a relationship between the distance between the light emitting device and the object and an ambient illuminance when the object can be visually confirmed.

A relationship between the distance Dx and the ambient illuminance of the object is derived from a relationship between the distance Dx and the resolution represented by the curves L1 to L6. FIG. 18 is a graph showing the relationship between the distance Dx and the ambient illuminance when the object is seen. The curve L7 represents a margin between the distance Dx and the ambient illuminance when the object is obviously seen. For example, from Table 1, it is known that when the ambient illuminance is 100 [lx], and the distance Dx is 30 cm, the object is obviously visible. In addition, in Table 2, it is known that when the ambient illuminance is 456 [lx], and the distance Dx is 90 cm, the object is obviously visible. Points representing two conditions described above are positioned on the curve L7. Therefore, in a case where a condition included in a region A1 above the curve L7 is satisfied, it is possible to obviously visually confirm the object through the light emitting device 10. Furthermore, the upper limit of the region A1 is defined by a curve L9 representing the visibility of solar light that is maximized as natural light.

In addition, a curve L8 represents a margin between the distance Dx and the ambient illuminance when the object is visible at least. For example, from Table 1, it is known that the object is visible when the ambient illuminance is 100 [lx], and the distance Dx is 90 cm. In addition, in Table 2, it is known that when the ambient illuminance is 456 [lx], and the distance Dx is 150 cm, the object is visible. Points representing two conditions described above are positioned on the curve L8. Therefore, in a case where a condition included in a region A2 that is surrounded by the curve L8 and the curve L7 is satisfied, it is possible to approximately obviously visually confirm the object through the light emitting device 10.

In addition, a region equivalent to the region A1 may be defined by three points on the curve L7. For example, it is considered that in a case where the relationship between the distance Dx and the ambient illuminance satisfies the condition of the distance Dx and the ambient illuminance represented by a point included in a region on an upper side from a straight line illustrated by a broken line connecting three points satisfying (30 cm, 100 [lx]), (90 cm, 456 [lx]), and (10000 cm, 100000 [lx]) together, it is possible to obviously visually confirm the object through the light emitting device 10.

Figure 19:
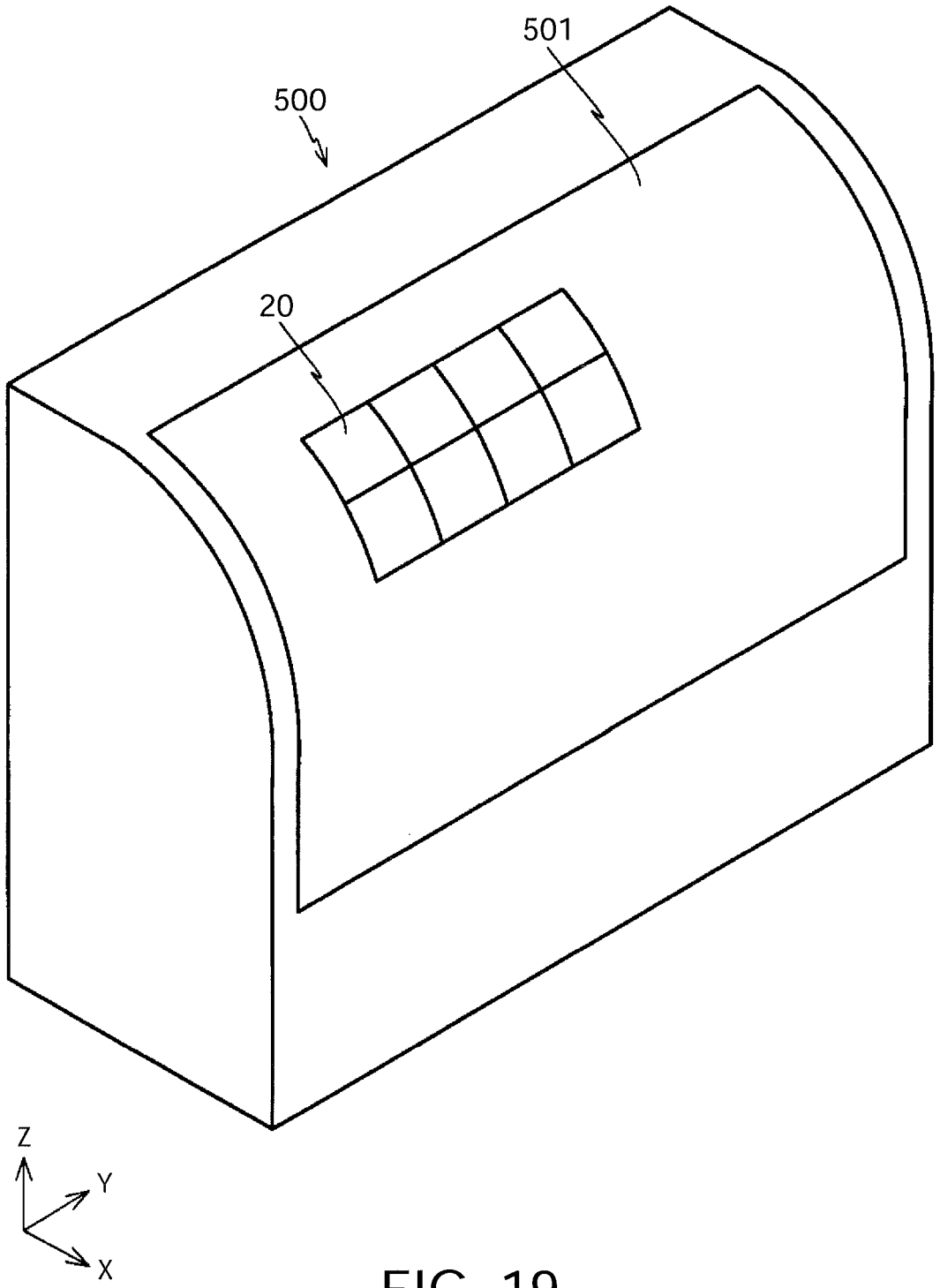
FIG. 19 is a diagram illustrating a showcase as a decoration device including the light emitting device.

FIG. 19 is a showcase 500 as the decoration device including the light emitting device 10. The object is arranged in the showcase 500, and the object can be visually confirmed from the outside through the curved glass 501. The light emitting device 10, for example, is arranged along an inner surface of curved glass 501. In this case, a distance between the object that is contained in the showcase 500 and the light emitting device 10 is set according to an ambient illuminance of the object that is contained in the showcase 500. Specifically, it is preferable that the condition of the ambient illuminance of the object and the distance is set to be included in the region A1 or the region A2 shown in FIG. 18. In addition, it is most preferable that the condition is set to be included in the region A1. Accordingly, it is possible to decorate the object by using the light emitting panel 20 without impairing the visibility of the object.

Figure 20:
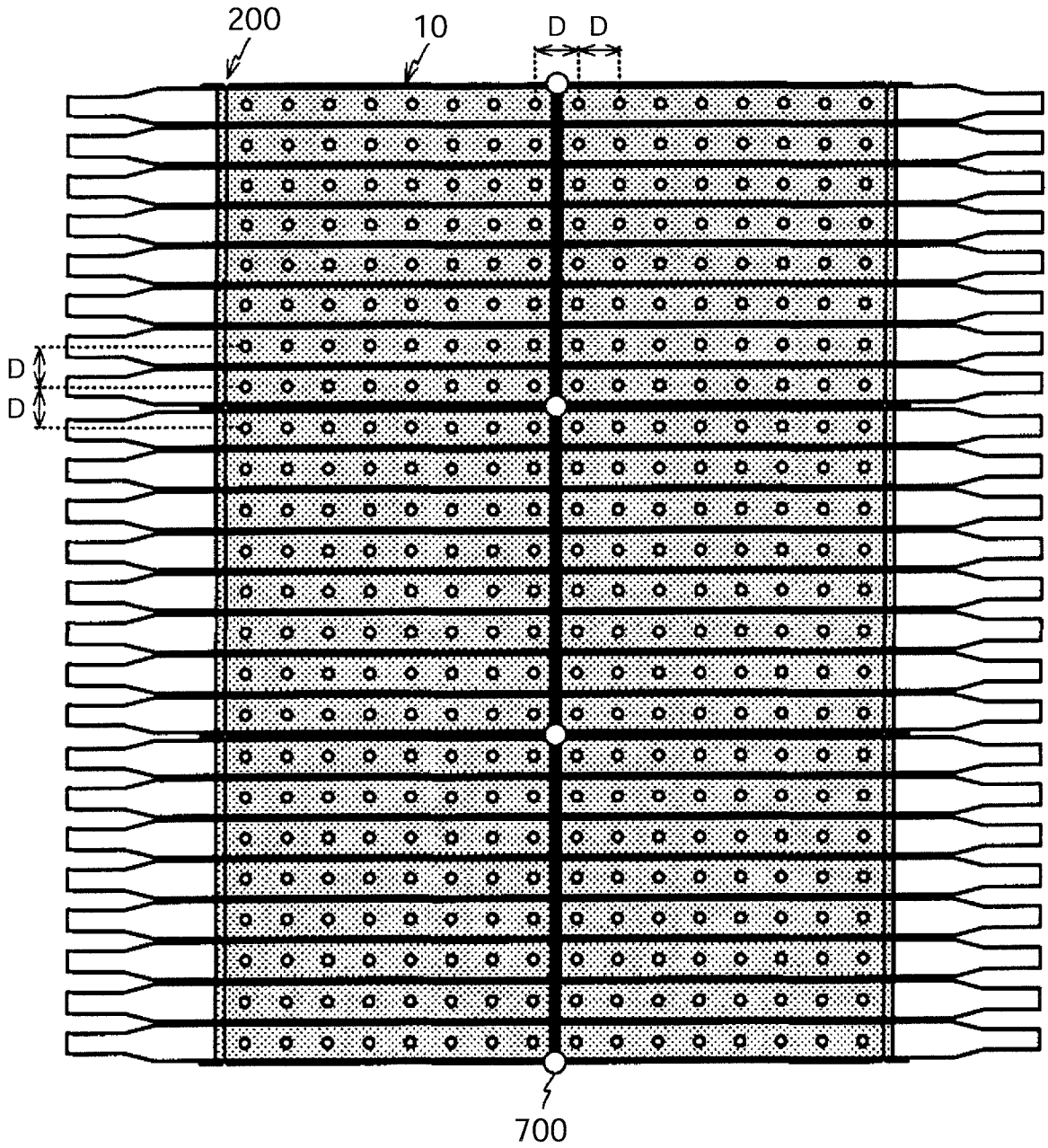
FIG. 20 is a diagram for describing a usage mode of the light emitting device.

In the light emitting panel 20 according to this embodiment, as illustrated in FIG. 8, each of the point light sources Gmn is arrayed such that the array pitch in the X axis direction and the Y axis direction is D, and the distance from the outer edge of the substrate 22 configuring the light emitting panel 20 to the closest point light source Gmn is D/2. Therefore, for example, as illustrated in FIG. 20, even in a case where a plurality of light emitting devices 10 are arranged such that the light emitting panels 20 are adjacent to each other, the array pitch of the point light sources Gmn between the light emitting devices 10 is D. Accordingly, the light emitting devices 10 are freely combined, and it is possible to expand the application of the light emitting device 10 or to improve the expressivity of the light emitting device 10.

In the light emitting panel 20 according to this embodiment, four circular notches 200 are provided. For this reason, as illustrated in FIG. 20, in a case where the plurality of light emitting devices 10 are arranged such that the light emitting panels 20 are adjacent to each other, a screw 700 is inserted into an opening or a semicircular notch that is formed by the notch 200, and thus, it is possible to fix each of the light emitting devices 10 to the object by using a screw or a washer. In addition, the notch 200 can be used as a standard position at the time of positioning the light emitting panel 20.

Figure 21:
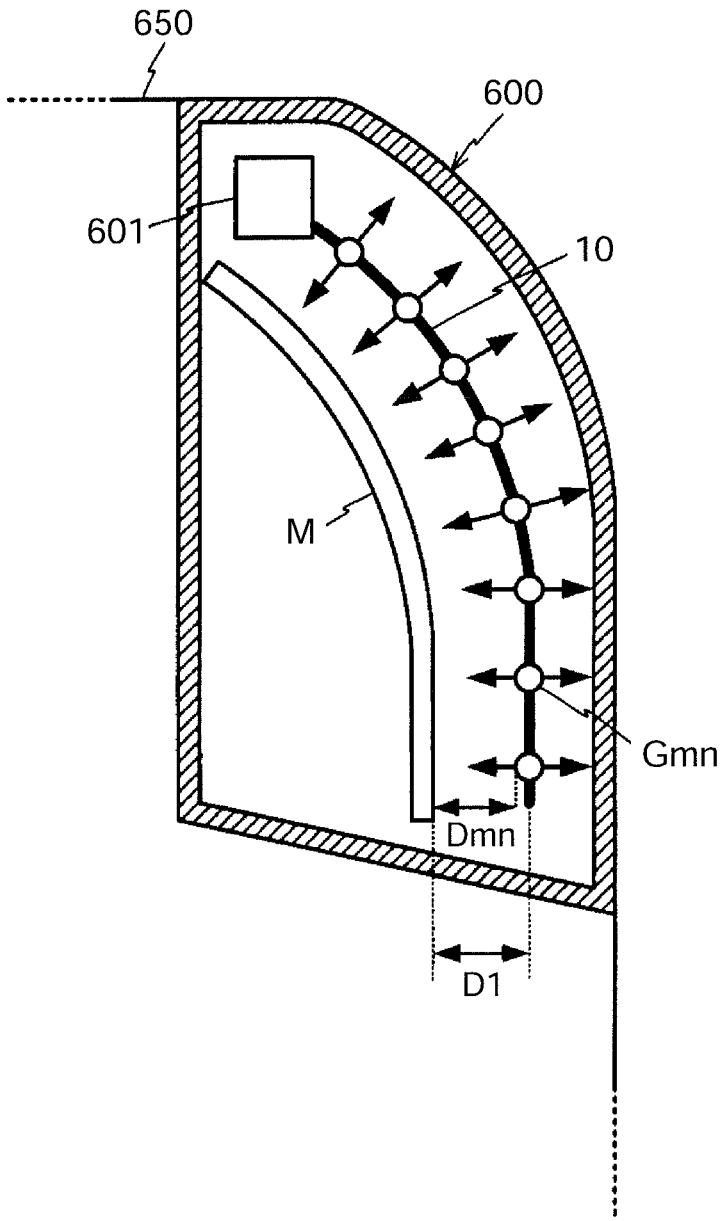
FIG. 21 is a diagram schematically illustrating a sectional surface of a resin housing on a horizontal surface and an internal structure in a tail lamp of an automobile.

In addition, the light emitting device 10 according to this embodiment can be used in a tail lamp of an automobile 650. The light emitting panel 20 having translucency and flexibility is used as a light source, and thus, it is possible to realize various visual effects. FIG. 21 is a diagram schematically illustrating a sectional surface of a resin housing on a horizontal surface and an internal structure in a tail lamp 600 of an automobile 650. The light emitting device 10 is arranged along an inner surface of the resin housing of the tail lamp 600, and a mirror M is arranged on a back surface of the light emitting device 10, and thus, light that exits from the light emitting device 10 to the mirror is reflected on the mirror M, and then, is transmitted through the light emitting panel 20, and exits to the outside. Accordingly, it is possible to effectively use light from the light emitting panel 20 of which both surfaces emit light, and to realize various visual effects.

It is preferable that the distance D1 between the light emitting device 10 and the mirror M is 0 cm to 60 cm. As illustrated in Table 1, it is considered that the distance D1 is within 60 cm, and thus, light from the point light source Gmn is evenly reflected on the mirror M. In addition, it is preferable that a difference in distances Dmn between each of the point light sources Gmn and the mirror M is within 30 cm. In addition, it is preferable that a difference between the maximum value and the minimum value of the distance Dmn between the point light source Gmn and the mirror M is within 30 cm. A distance of 30 cm is a distance in which the point light source Gmn can be clearly observed from the position of the mirror M. In addition, the light emitting device 10 is controlled by a control device 601.

In addition, the light emitting device 10 according to this embodiment is applied to various decoration instruments such as a showcase or a shop window by using bendability, transparence, a characteristic that both surfaces emit light, and the like, but an application example of the light emitting device 10 is not limited thereto. The light emitting device 10 may be used in various industrial products. For example, the light emitting device 10 of this embodiment may be incorporated in a tail light of a train, and a brake light of a tram, a bicycle, or the like.

In the light emitting device 10 according to this embodiment, the light emitting elements 30R, 30G, and 30B or the conductor layer 23 are watertight by the resin layer 24. For this reason, the light emitting device 10 can be arranged in water.

In this embodiment, the light emitting elements 30R, 30G, and 30B are connected to each other by 24 individual line patterns G1 to G8, R1 to R8, and B1 to B8, and the common line pattern CM that are formed of the mesh pattern. The mesh pattern described above is configured of a metal thin film having a line width of approximately 5 μm. For this reason, it is possible to sufficiently ensure the transparence and the flexibility of the light emitting device 10.

In this embodiment, in the set of substrates 21 and 22, the conductor layer 23 including the conductor patterns 23*a* to 23*h* is formed on the upper surface of the substrate 21. For this reason, the light emitting device 10 according to this embodiment is thin compared to a light emitting device in which the conductor layer is formed on both of the upper surface and the lower surface of the light emitting elements 30R, 30G, and 30B. As a result thereof, it is possible to improve the flexibility and the transparency of the light emitting device 10.

Figure 22:
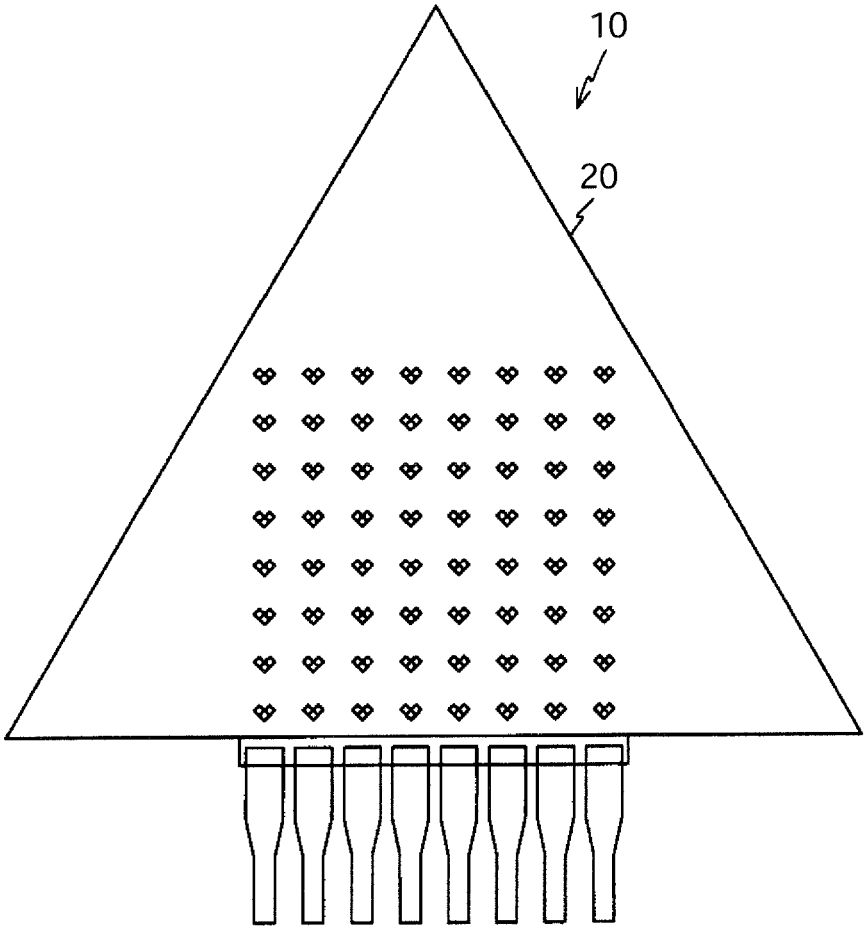
FIG. 22 is a diagram for describing a modification example of the light emitting device.
Figure 23:
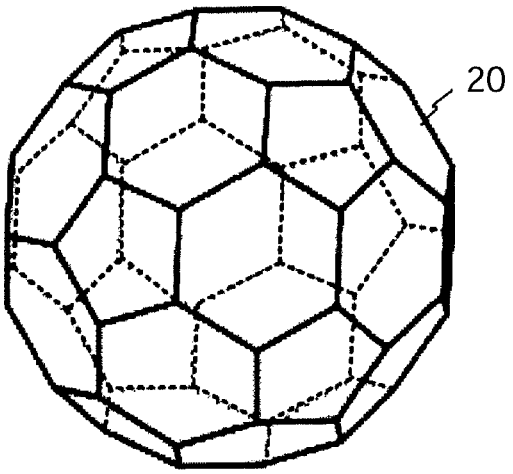
FIG. 23 is a diagram for describing a modification example of the light emitting device.

The embodiment of the invention is described above, but the invention is not limited to the embodiment described above. For example, in the embodiment described above, a case is described in which the light emitting panel 20 of the light emitting device 10 is in the shape of a quadrangle. The invention is not limited thereto, and for example, as illustrated in FIG. 22, the light emitting panel 20 may be in the shape of a triangle. In addition, the light emitting panel 20 may be in the shape of a polygon such as a pentagon or a hexagon. In addition, the plurality of light emitting devices 10 may be overlappingly arranged. The light emitting panel 20 is formed into the shape of a triangle, a pentagon, or a hexagon, and thus, for example, as illustrated in FIG. 23, the light emitting panel 20 can be combined into the shape of a polyhedron such as a tetrahedron or an octahedron.

Figure 24:
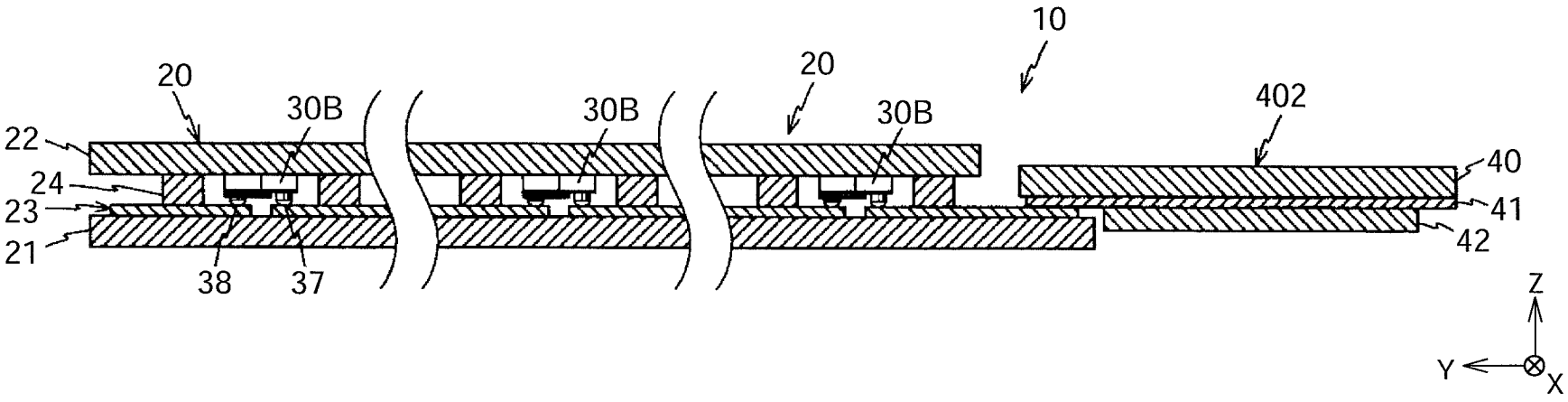
FIG. 24 is a diagram for describing a modification example of the light emitting device.

In the embodiment described above, a case is described in which the resin layer 24 is formed without a gap between the substrates 21 and 22. The invention is not limited thereto, and the resin layer 24 may be partially formed between the substrates 21 and 22. For example, the resin layer 24 may be formed only around the light emitting element. In addition, for example, as illustrated in FIG. 24, the resin layer 24 may be formed to configure a spacer that surrounds the light emitting elements 30R, 30G, and 30B.

Figure 25:
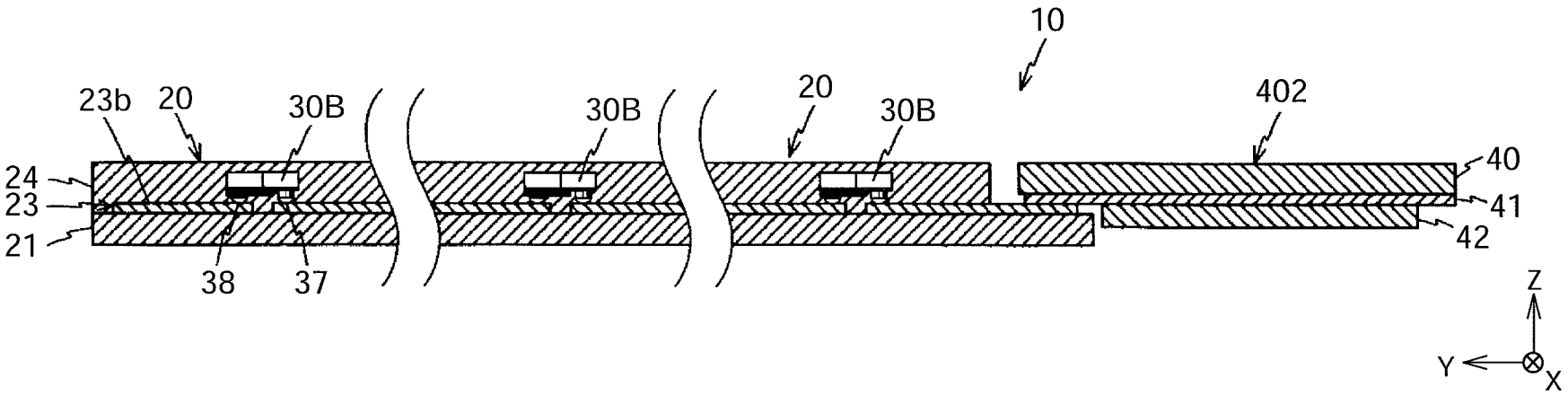
FIG. 25 is a diagram for describing a modification example of the light emitting device.

In the embodiment described above, a case is described in which the light emitting panel 20 of the light emitting device 10 includes the substrates 21 and 22, and the resin layer 24. The invention is not limited thereto, and as illustrated in FIG. 25, the light emitting panel 20 may include only the substrate 21, and the resin layer 24 retaining the light emitting elements 30R, 30G, and 30B.

In the embodiment described above, a case is described in which the resin layer 24 is formed of a thermosetting resin sheet 241 and a thermosetting resin sheet 242. The invention is not limited thereto, and the resin layer 24 may be formed of a thermoplastic resin sheet. In addition, the resin layer 24 may be formed of both of a thermosetting resin and a thermosetting resin.

In the embodiment described above, a case is described in which the conductor layer 23 is formed of a metal material such as copper (Cu) or silver (Ag). The invention is not limited thereto, and the conductor layer 23 may be formed of a transparent material having conductivity such as indium tin oxide (ITO).

In the embodiment described above, as illustrated in FIG. 1, a case is described in which the light emitting device 10 includes the point light sources Gmn that are arranged into the shape of a matrix of eight rows and eight columns. The invention is not limited thereto, and the light emitting device 10 may include the point light sources Gmn that are arranged in nine or more rows or eight or more columns.

In the embodiment described above, as illustrated in FIG. 2, a case is described in which three light emitting elements 30R, 30G, and 30B are arranged into the shape of L. The arrangement of the light emitting elements is not limited thereto, and for example, three light emitting elements 30R, 30G, and 30B may be arranged linearly or to be simply close to each other.

In the embodiment described above, a case is described in which the light emitting elements 30G and 30B are adjacent to the light emitting element 30R. The array order of the light emitting element 30 is not limited thereto. For example, the other light emitting element 30 may be adjacent to the light emitting element 30G or the light emitting element 30B.

Figure 26:
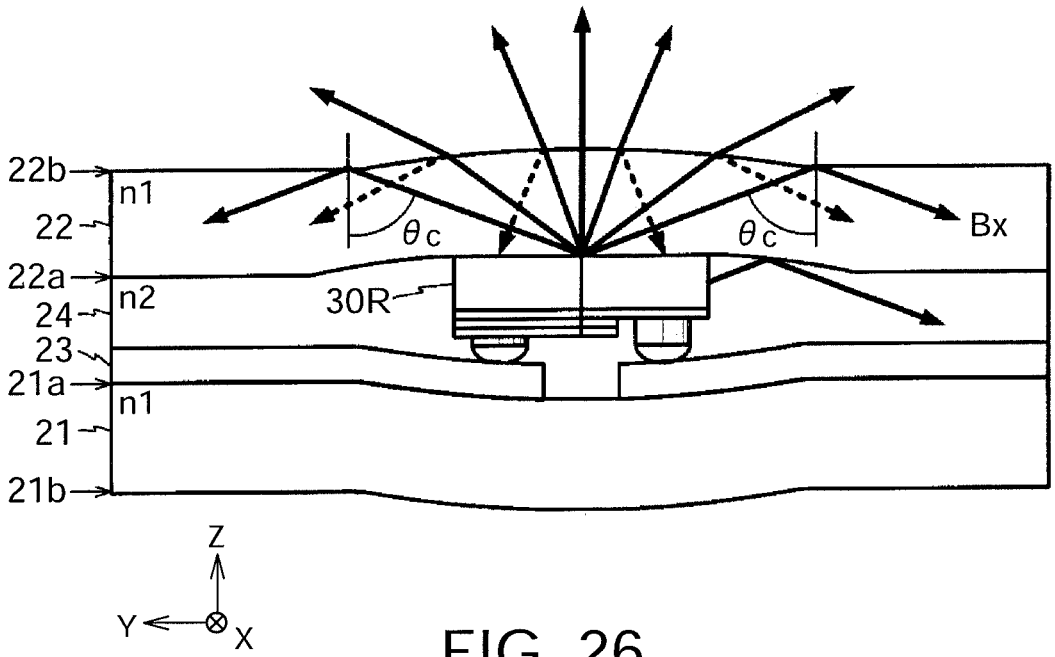
FIG. 26 is a diagram for describing light diffusion in the light emitting device.

In addition, the light emitting panel 20 of the light emitting device 10 is formed by heating and pressure bonding each of the substrates 21 and 22, under a vacuum atmosphere. Accordingly, as illustrated in FIG. 26, in the substrates 21 and 22, a portion in which the light emitting element 30R is positioned protrudes to the outside. For this reason, outer surfaces 21*b* and 22*b* and inner surfaces 21*a* and 22*a* of the substrates 21 and 22 are bent to surround the light emitting element 30R. Therefore, light from the light emitting element 30R is diffused by a lens effect due to the deformation of the substrates 21 and 22. In addition, the refractive index n1 of the substrates 21 and 22 is different from a refractive index n2 of the resin layer 24. For this reason, light is diffused on a boundary between the substrates 21 and 22 and the resin layer 24. In addition, light from the light emitting element 30R is also diffused due to diffused reflection on the electrode or the bump, or the fact that the substrates 21 and 22 or the resin layer 24 is not completely transparent. In consideration of the light diffusion as described above, the object may be decorated with the light emitting device 10.

Figure 31:
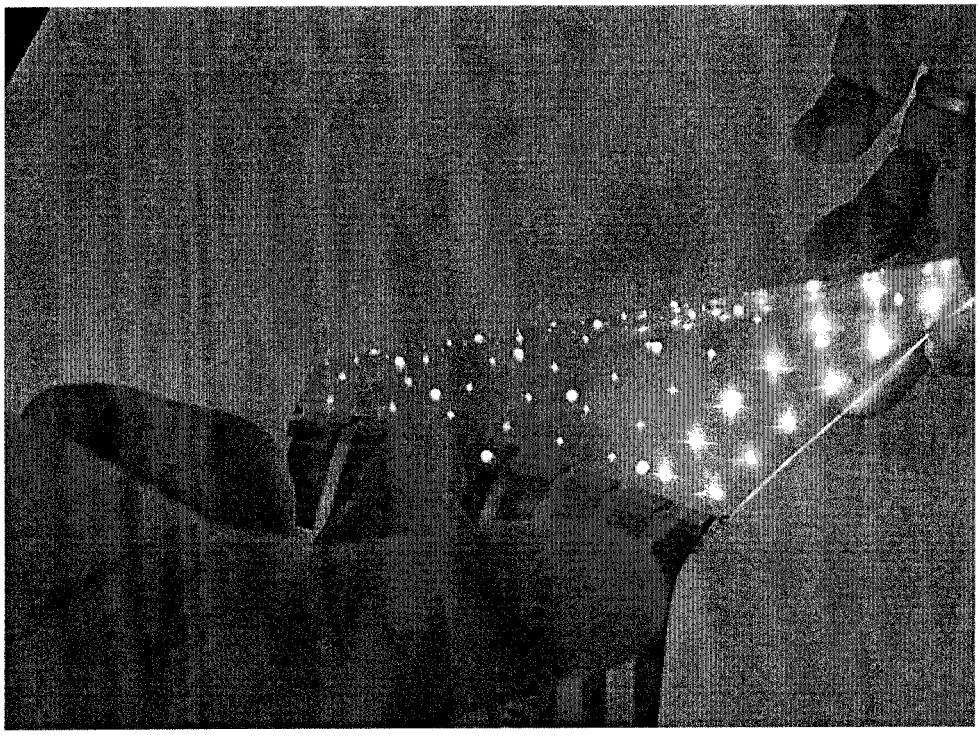
FIG. 31 is a picture of the light emitting device.

In addition, the light emitting device 10 has flexibility. For this reason, as illustrated in a picture of FIG. 31, the light emitting device 10 may be used in folding decoration.

Some embodiments of the invention are described, but such embodiments are presented as an example and are not intended to limit the scope of the invention. Such novel embodiments can be implemented in other various forms, and various omissions, replacements, and changes can be made without departing from the gist of the invention. Such embodiments and modifications thereof are included in the scope or the gist of the invention, and are included in the invention described in the claims and the equivalents thereof.

EXPLANATIONS OF LETTERS OR NUMERALS

10 LIGHT EMITTING DEVICE
20 LIGHT EMITTING PANEL
21 SUBSTRATE
21*a*, 21*b*, 22*a*, 22*b* SURFACE
22 SUBSTRATE
23 CONDUCTOR LAYER
23*a* TO 23*h* CONDUCTOR PATTERN
24 RESIN LAYER
30R, 30G, 30B LIGHT EMITTING ELEMENT
31 BASE SUBSTRATE
32 N TYPE SEMICONDUCTOR LAYER
33 ACTIVE LAYER
34 P TYPE SEMICONDUCTOR LAYER
35, 36 PAD ELECTRODE
37, 38 BUMP
40 BASE SUBSTRATE
41 CONDUCTOR PATTERN
42 COVERLAY
90 OBJECT
91 TEST TARGET
91*a* PAPER
91*b* TEST PATTERN
500 SHOWCASE
501 CURVED GLASS
600 TAIL LAMP
601 CONTROL DEVICE
650 AUTOMOBILE
700 SCREW
401 TO 408 FLEXIBLE CABLE
A1, A2 REGION
R1 TO R8, G1 TO G8, B1 TO B8 INDIVIDUAL LINE PATTERN
CM COMMON LINE PATTERN
CM1 MAIN PORTION
CM2 BRANCH PORTION
D1, D2 DUMMY LINE PATTERN
Gmn POINT LIGHT SOURCE
M MIRROR
PD CONNECTION PAD

What is claimed is:

1. A vehicle comprising:

a light emitter for a vehicle, the light emitter including a light emitting device having light transmittivity and flexibility, a plurality of light emitting elements, each of the light emitting elements emitting light from a first surface thereof and a second surface thereof, and a reflection member positioned in a portion of the light emitter separated from the light emitting device by a predetermined distance, wherein a distance between the light emitting device and the reflection member is 0 cm to 60 cm.

2. The vehicle according to claim 1, wherein distances between each of the plurality of light emitting elements and the reflection member are identical to each other.

3. The vehicle according to claim 2, wherein a difference in the distances between each of the plurality of light emitting elements and the reflection member is within 30 cm.

* * * * *